US006269650B1

(12) United States Patent
Shaw

(10) Patent No.: US 6,269,650 B1
(45) Date of Patent: Aug. 7, 2001

(54) AIR CONDITIONING CONTROL SYSTEM FOR VARIABLE EVAPORATOR TEMPERATURE

(76) Inventor: Allan Shaw, 8 Hood St., Linden Park, South Australia 5065 (AU)

( * ) Notice: Subject to any disclaimer, the term of this patent is extended or adjusted under 35 U.S.C. 154(b) by 0 days.

(21) Appl. No.: 09/595,454

(22) Filed: Jan. 10, 2000

Related U.S. Application Data

(63) Continuation of application No. PCT/AU98/00536, filed on Jul. 10, 1998.

(30) Foreign Application Priority Data

Jul. 10, 1997 (AU) ..... PO7836

(51) Int. Cl.[7] ..... F24F 3/14

(52) U.S. Cl. ..... 62/176.6; 62/176.3; 62/201; 62/185; 62/229; 62/228.4; 62/228.3; 236/44 C

(58) Field of Search ..... 62/176.1, 176.2, 62/176.3, 176.6, 180, 226, 227, 228.1, 228.3, 228.4, 228.5, 201, 185; 236/44 R, 44 A, 44 C; 165/222, 223, 225, 230

(56) References Cited

U.S. PATENT DOCUMENTS

| | | | | |
|---|---|---|---|---|
| 4,257,238 | | 3/1981 | Kountz et al. | 62/229 X |
| 4,319,461 | * | 3/1982 | Shaw | 62/93 |
| 4,512,161 | | 4/1985 | Logan et al. | 62/176.6 |
| 4,876,858 | * | 10/1989 | Shaw et al. | 62/93 |
| 4,942,740 | * | 7/1990 | Shaw et al. | 62/93 |
| 5,346,129 | | 9/1994 | Shah et al. | 236/44 C |
| 5,461,877 | * | 10/1995 | Shaw et al. | 62/185 |

FOREIGN PATENT DOCUMENTS

| | | |
|---|---|---|
| 49875/79 | 8/1979 | (AU) . |
| 81946/87 | 5/1988 | (AU) . |
| 18873/92 | 12/1992 | (AU) . |

* cited by examiner

*Primary Examiner*—Harry B. Tanner
(74) *Attorney, Agent, or Firm*—Akerman Senterfitt

(57) ABSTRACT

A system and method of control of refrigerant air conditioning including a humidity input sensor, and a coolant velocity sensor, using a control system set with a set point whereby to maintain a maximum evaporator temperature set point varying to suit each heat and moisture load condition over a range of conditions compatible with high engineering standards of performance.

24 Claims, 10 Drawing Sheets

Constant Air Volume System

Block Diagram of Evaporator Pressure Control System

Evaporator interchanging directly with treated air

Constant Air Volume System

Variable Air Volume System

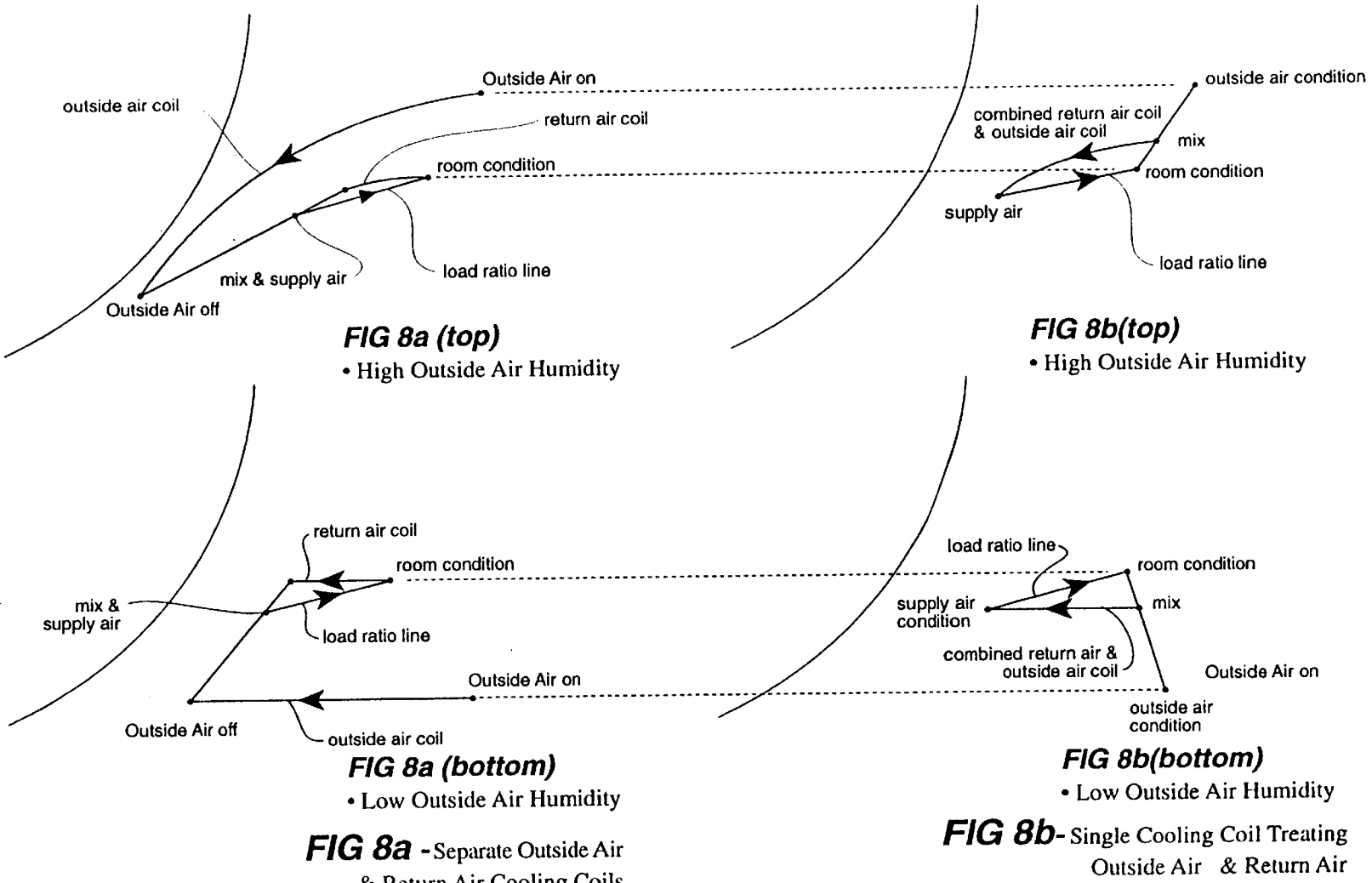
FIG 8a (top)
• High Outside Air Humidity
FIG 8b(top)
• High Outside Air Humidity
FIG 8a (bottom)
• Low Outside Air Humidity
FIG 8b(bottom)
• Low Outside Air Humidity
FIG 8a - Separate Outside Air & Return Air Cooling Coils
FIG 8b- Single Cooling Coil Treating Outside Air & Return Air
FIG 8 Psychrometric Studies Comparing Dual & Single Coil Constant Air Volume System Performance

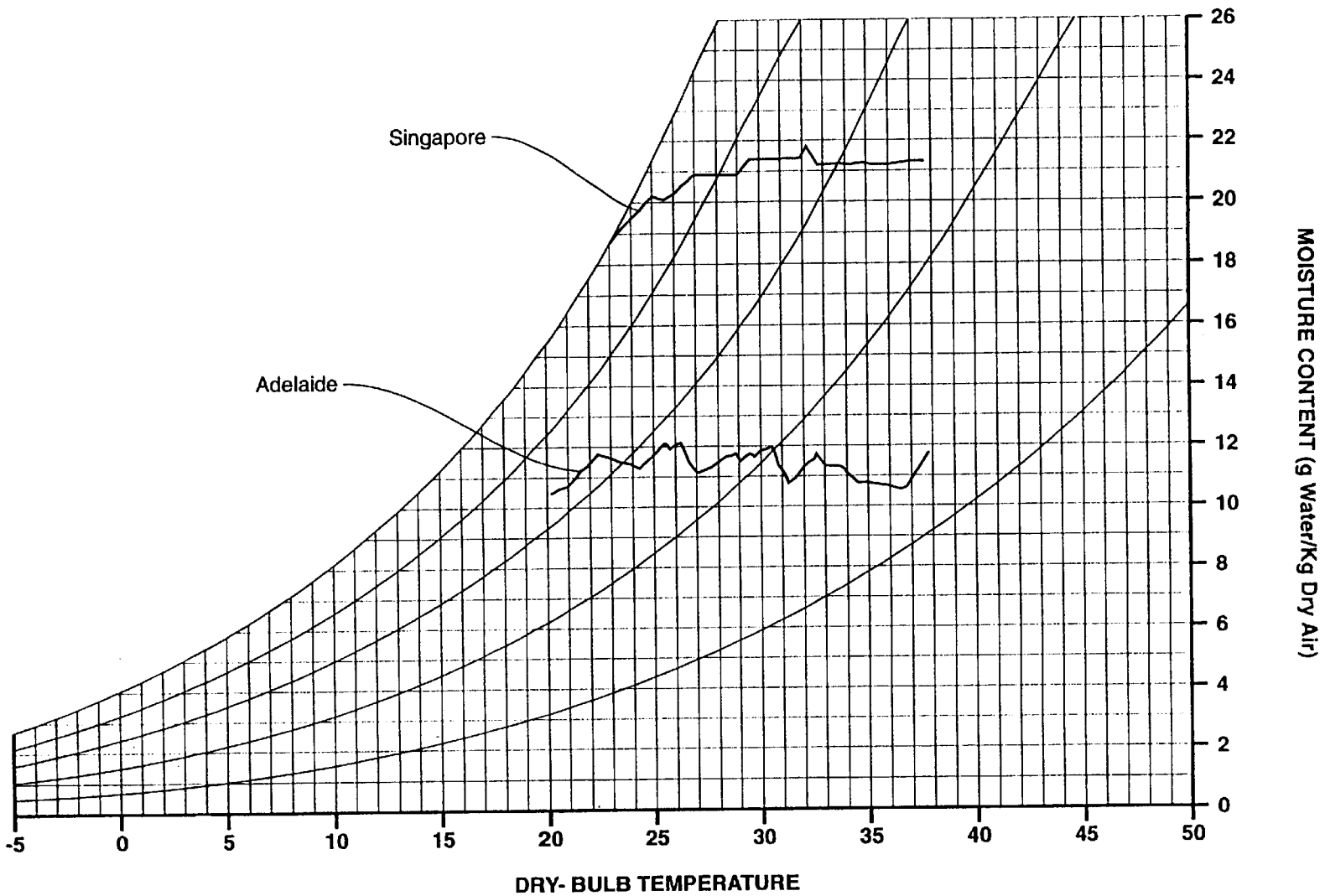
FIG 9 Weather Data

Variable Speed Control Module

AIR CONDITIONING CONTROL SYSTEM FOR VARIABLE EVAPORATOR TEMPERATURE

This is a continuation of PCT International Application No. PCT/AU98/00536, filed Jul. 10, 1998 and designating, among other states, the United States of America.

BACKGROUND OF THE INVENTION

This invention relates to air conditioning improvements.

An object of this invention is to assist in reducing energy required to effect air conditioning while obtaining high performance standards over the full operating range. Environment control by air conditioning means involves more than simply increase or decrease of the total capacity, but rather, dependent on the relative values of latent heat which are to be simultaneously offset in a manner that the lag in the process of mass transfer behind heat transfer does not contribute an energy penalty.

The problem to which this invention is directed is the problem of how to reduce energy required to effect acceptable refrigerant air conditioning for comfort purposes. The system presented here resolves the chaos arising from the contradictory effects of numerous variables in infinite combinations which are involved in refrigerated air conditioning design. Two of these unrelated variables, sensible and latent heat appear in both the room treated air and the outside air introduced for ventilation. Sensible cooling and dehumidification pass through unrelated processes. Heat transfer can occur with only a dry bulb temperature difference between the air and the cooling coil whereas mass transfer will not proceed at all without contact with a cooling surface which is below that of the dew point temperature of the moist air. To put it in terms of the partial pressure of the water vapour in the treated air, dehumidification from the treated air will not proceed until there is a partial pressure difference with the wetted interface of the cooling surface.

PRIOR ART

Closest prior art known to the Applicant are publications of Australian Patents entitled "Method of Air Conditioning" AU-B-49875/79 (597757), "Air Conditioner and Method of Dehumidifier Control" AU-B-81946/87 (662336), and "Air Conditioning for Humid Climates" AU-B-18873/92.

BRIEF SUMMARY OF THE INVENTION

In one form the invention can be said to reside in an air conditioning system including refrigeration means to effect a highest evaporator temperature for its refrigeration cycle when it treats either directly or indirectly cooling and dehumidifying of air to be conditioned, dry bulb temperature measuring means to measure the temperature of air within a space to be conditioned, humidity measuring means to measure humidity of air within the space to be conditioned, and control means adapted to offset both sensible and latent heat loads of the air at each of the climatic and interior building load conditions over the operating range of the air conditioned system, and control means to establish humidity performance in the treated space at a high end of an acceptable range, and, if a chiller is employed, at the high end of the acceptable coolant coil velocity performance range, where the higher of these two properties reach its set point value, in combination with the sensible heat and latent heat loads being offset by the refrigeration cycle, will be generating the value of an evaporator temperature set point varying to be as high as design condition permits to minimise input energy to the refrigeration compressor and maintain high standard performance conditions compatible with the particular operating condition in the range and on a change of load, will automatically vary the evaporator temperature set point so that it is again compatible with each of all the sensible and latent heat loads occurring over the operating range of the system, the control means employed would at each operating condition in the range determine the specific volume at the saturated suction temperature of the refrigerant leaving the evaporator to establish the higher of the said two constant space humidity or coil coolant velocity set points and then calculate the evaporator set point which in the case of this embodiment drives the variable speed control of the compressor motor.

In an alternative description there is proposed method of capacity control of an air conditioning system including a compressor and evaporator in a refrigeration cycle, heat exchanger means, coolant flow conduits, control equipment including compressor, flow control means, proportional plus integral control output equipment and final control means said method including generating an evaporator pressure/temperature set point for the evaporator to vary so as to be as high as sound engineering principles permit in order to address each of the different operating conditions occurring over a total air conditioning range and not to depart from the high standards of performance governed by the principles of combined heat and mass transfer, fluid flow, energy minimisation and human health and comfort.

In a further alternative description there is proposed a refrigerant air conditioning arrangement of a type including refrigeration means to provide a cooling evaporator either directly for air to be conditioned or indirectly for the air to be conditioned through a chiller, dry bulb temperature measuring means to measure the temperature of air within a space being air conditioned, control means connected to the dry bulb temperature measuring means effecting control of the refrigerant flow and/or coolant flow through the area of cooling surface available to the air being cooled, further characterised in that there are included humidity measuring means to measure humidity of air within the space being air conditioned, and further control means to effect a change in the evaporator temperature in response to the treated space humidity measuring means or the coolant velocity through the coolant coils interfacing with the treated air means to maintain a refrigerant evaporator temperature which is as high as sound engineering principles permit in order to address each of the operating internal and external heat and moisture load conditions occurring over a total air conditioning range.

This invention is applicable to both constant air volume and variable air volume refrigerant air conditioning systems, and enables higher efficiencies in such air conditioning systems over that which is currently the case.

This is achieved, by setting control means to vary the value of a high evaporator temperature to be compatible with each operating condition in the range within the bounds of good performance standards including fluid flow, heat and mass transfer principles and energy minimisation as a priority.

In preference the method includes utilising a control system to effect humidity control and coolant velocity control to use set points representing a design space humidity or design coolant velocity through the tubes of the coils, whichever is the greater, with reference to their respective set points. Thereby this control system will establish a highest acceptable evaporator temperature set point for that particular operating condition in the air conditioning range.

In the absence of chillers, when the evaporator interfaces directly with the treated airstream there is only a humidity set point required. However when a humidity of air in the space to be conditioned does not reach its set point, as may be the case during low humid outside air conditions, in lieu of a secondary coolant velocity set point, a minimum speed setting of the compressor determined by the compressor manufacturer can be supplied within a variable speed control device as is employed in the embodiment of this invention or equivalent means to increase the saturated suction temperature/pressure of the evaporator.

In explaining this invention I observe that there is complex incompatibility in relationships between heat and mass transfer, limitations applied to maintain turbulent coolant flow performance at the heat exchangers and the problems arising when a ratio of internal sensible heat loads to internal total heat loads present a design problem. Reducing total heat loads are not necessarily associated with reducing volume flow rate at the suction of the compressor and increasing total heat loads are not necessarily associated with increasing the volume flow rate at the suction of the compressor. It is not volume flow rate of refrigerant but rather mass flow rate which is associated with changes in heat loads. A denser refrigerant vapour serving an increasing load will have a reduced volume flow rate.

According to this invention there can now be provided a system of capacity control of refrigerant air conditioning which will control whether a volume flow rate of the refrigerant rses or falls on a change in climatic and internal heat and moisture conditions. Should it fall, input energy is reduced and treated space humidity or coolant velocity is increased. According to this invention there is established a lowest volume flow rate to maintain required preselected conditioned air characteristics.

Factors which can pose problems in capacity control include lag between simultaneous dehumidification and cooling processes, and instability arising from coolant flow which has fallen from turbulent to transition flow when a total load falls to about 30% to 50% below peak cooling loads. There is also an undesirable effect of high coolant flow rising above known standards. The invention proposes having a control priority of achieving a highest evaporator temperature feasible for reduced input energy while overcoming these limitations.

The capacity control system in accord with this invention is compatible with numerous conventional arrangements. Through the use of embodiments employing an open reciprocating compressor with variable speed control equipment, the system has been demonstrated for both a constant air volume and variable air volume system. In addition to speed control it is compatible with compressors employing cylinder unloading and rotary screw compressors equipped with sliding valves. In the case of centrifugal compressors it is compatible with pre-rotating vanes and also multiple flow temperature systems.

Use of systems dependent solely on throttling the refrigerant as the capacity control means are not preferred nor hot gas bypass because of their implicit inefficiency.

Relevant to the degree of energy saved is the arrangement of the coils and their circuiting. In one arrangement recommended and used in an embodiment of this invention as in FIG. 1*a* and FIG. 8*a* top, the outside air coil is employed at what it can do better than the return air coil. It is selected to not only cool and dehumidify the outside air to the supply temperature of treated air that is introduced into the air conditioned space but to have the capacity to dehumidify the air to offset all or a large part of the internal latent heat loads when these are high, and also part of the internal sensible heat loads. This is achieved by employing all or most of the coolant required during the peak simultaneous load to flow first through the outside air coil before flowing on to serve the return air coils.

In this manner the temperature rise of the coolant through the outside air coil is drastically reduced and the mass transfer at the wetted interface surfaces of this outside air coil during periods of high moisture content in the air is high. In this manner a coolant flow is created which approaches a sink temperature as indicated in FIG. 1 (*a*) in contrast to a conventional outside air coil in the case as indicated in FIG. 1 (*b*). As a consequence in the case of FIG. 1*a,* the low dew point temperature of outside air leaving its coil, on mixing with the return air leaving its coil results in a reduced dew point temperature of the supply air to the treated spaces. The return air coil is smaller since the outside air coil handles part of the room sensible heat load as well as part of or all of the latent heat load.

By this arrangement not only is the lag of mass transfer behind heat transfer overcome, but the reduction in treated space humidity permits the evaporator temperature to increase to a higher value which is limited only by design maximum set points for space humidity or a design maximum set point for secondary coolant flow, whichever is the greater. According to the capacity control system in accord with this invention, the output from this set point determines the evaporator temperature set point.

There are two major factors of significance namely, the capacity control system and the arrangement of the coils and circuits which link the capacity control system to the cooling and dehumidifying coils.

The arrangement described above where a separate outside air coil and separate return air coil is used can however be misapplied. If the outside air consists of 20% of the supply air, in order to offset 1 gram of moisture per kg of dry air in the treated space, the outside air would have to condense 5 grams of moisture per kg of dry air. If the outside air consisted of only 10% of the supply air in order to reduce 1 gram of moisture per kg of dry air, 10 grams of moisture would have had to be condensed from the outside air. In spite of this limitation the room sensible heat ratio is in most cases high enough not to be adversely affected.

In lieu of the use of the outside air and return air 2 coil arrangement described in Table 1 for peak load condition on row 4*a* and also as in FIG. 8*a*, an altemative, as indicated in FIG. 8*b* top where a single coil arrangement serving the combined mixture of both outside air and return air is very limited in application.

When a single coil is employed to treat both the ventilation air and the return air, two very differing combinations of sensible and latent heat loads are to be offset simultaneously with the same cooling surface. The consequence is an energy wasteful system. Unfortunately this is a very popular system in medium and low humidity climates. It is a system which, as far as energy savings is concerned, is based on fallacious reasoning.

The outside air combination of sensible and latent heat loads may require a coolant supply temperature that is very low, see FIG. 8*b* top, whereas return air combination of sensible and latent heat loads may be offset with a considerably higher coolant supply temperature. Again, this relates to the early days when energy was not considered important. At the time when the outside air is at a high dew point temperature, a low coolant supply temperature may be necessary to offset the loads. This means that smaller internal room loads are over cooled. Then the supply air to the rooms must be reheated.

In some cases the designer manages to avoid part or all of the reheating by allowing the room dry bulb temperature to be lower. Nevertheless, it is still wasteful since the larger return air portion of the outside air, return air combination had been over cooled unnecessarily. In the absence of reheating, the treated space is often too cold for comfort for the occupants dressed in their summer attire. The use of the single coil is an example where the driving force for dehumidification from the outside air is very much reduced when it is mixed with the return air from the treated space.

During dry outside air conditions, even with high outside air dry bulb temperatures the system according to this invention when employing separate outside air and return air coils without any additional equipment takes advantage of outside air dew point temperatures below that of the supply air dew point temperature to the treated space. On mixing with the return air the internal latent heat loads in whole or in part are offset and consequently reduces the use of input energy to offset the internal latent heat loads. The high return air coil coolant temperature prevents or reduces dehumidification by the refrigeration system. This is further described herein under the heading of "humidity economy cycle" on page 18.

The contribution derived from this invention can best be revealed when the capacity control system of this invention is assessed at the time the system is at a balance point. At such times in the absence of this invention, the humidity within the treated space may be both at an acceptable humidity below the maximum acceptable design set point in the humidity range and below the maximum acceptable design set point in the liquid coolant velocity range. Since neither of these two controlled values is at its respective maximum set point the evaporator temperature/pressure is not at its preferred design setting and the control system in this embodiment of the invention increases the evaporator temperature by raising the higher of these two values to its respective control set point. This will not upset the balance point except favourably in that there will be a rise in the evaporator and coolant supply temperatures due to a rise in the humidity of the treated space or a rise in the coolant velocity by the proportional plus integral control system of this invention and thus a reduction in the energy necessary to dehumidify the treated space. The invention is not intrusive to existing methods. Apart from this reduction due to a higher evaporative temperature level the mass flow rate at the suction of the compressor at the lower evaporator temperature and the mass flow rate at the suction of the compressor when at its higher design evaporator temperature for its particular condition in the operating range would be close to equal. It is only the volume flow rate entering the suction of the compressor when it is at a lower evaporator temperature which will be greater than the volume flow rate entering the suction of compressor when it is at the higher evaporator temperature. Thus this capacity control system is not invasive to the traditional control methods such as regulating the flow rate of the coolant when the dry bulb temperature of a treated space rises or falls. It simply regulates the position of the evaporator temperature to be at a maximum value that is compatible with the existing balance point condition.

In the case when the treated air interfaces directly with the evaporator, the compressor speed must be above the minimum permissible for the particular compressor employed. A minimum speed setting is supplied within the Variable Speed Control device. There is no fixed coil which has a fixed supply coolant temperature that can service a complete range of say from peak to 35% of peak load by establishing the highest evaporator temperature set point.

Table 1 represents an embodiment of the invention employing a constant air volume system with a separate outside air and return air coil. Air conditioning standards, when liquid coolants are employed demand turbulent flow at all operating conditions. This is not possible over the usual cooling season climatic range when the supply temperature is fixed. For example the return air coil during peak load in Table 1 row 4*a* has a chilled water velocity of 2.23 m/s. However at a part load condition, Table 1, row 4*e* the chilled water velocity has reduced exponentially to a value of only 0.25 m/s. A further small fall in load would result in unstable performance into transition flow where the Reynolds number is below 2300 and the coolant velocity is below 0.2 m/s.

In this embodiment of the invention turbulence is maintained by reducing the size of the return air coil from 4 rows to 2 rows as is demonstrated in Table 1 row 4*e* converting to row 2*a* which has a return air coil water velocity of 1.96 m/s.

Similarly Table 5 representing a variable air volume system will respond with a change in size of cooling coil to fit the size range. For example condition o which has a higher peak coolant supply temperature of 9*c*, (associated with a higher evaporator temperature), is at minimum coolant velocity of 0.2 m/s on a fall in load would change over from a 4 row coil, row o, to a 2 row coil row r, which is also at similar load conditions but has the higher chilled water velocity of 1.25 m/s.

In the case of Tables 2*a*, 2*b*, 3 and 4 increase in the evaporator set point leading to a higher chilled water supply temperature not only decreases energy input and energy output but also serves to maintain turbulence levels through the capacity control system of this invention.

Table 5 also indicates the importance of this increase in evaporator temperature set point. See section below under heading: SUMMARY OF ADVANTAGES.

Tables 3 and 4 are very special cases involving an outside air condition which has a dew point temperature below that of the dew point temperature of the supply air. This will be discussed when the new "humidity Economy Cycle" of this system will be explained on page 18.

BRIEF DESCRIPTION OF THE PREFERRED EMBODIMENTS

Examples of the invention are described hereunder in some detail with reference to, and are illustrated in, the accompanying drawings and charts wherein:

FIG. 1(*a*) refers to the performance of the outside air coil in the arrangement of separate outside air and return air coils discussed in detail above on page 5 beginning with line 10. It is of advantage where a significant outside air percent of the supply air of about 15% or more is required. Otherwise a modified arrangement of outside air plus return air coil should be considered.

Figure 3:
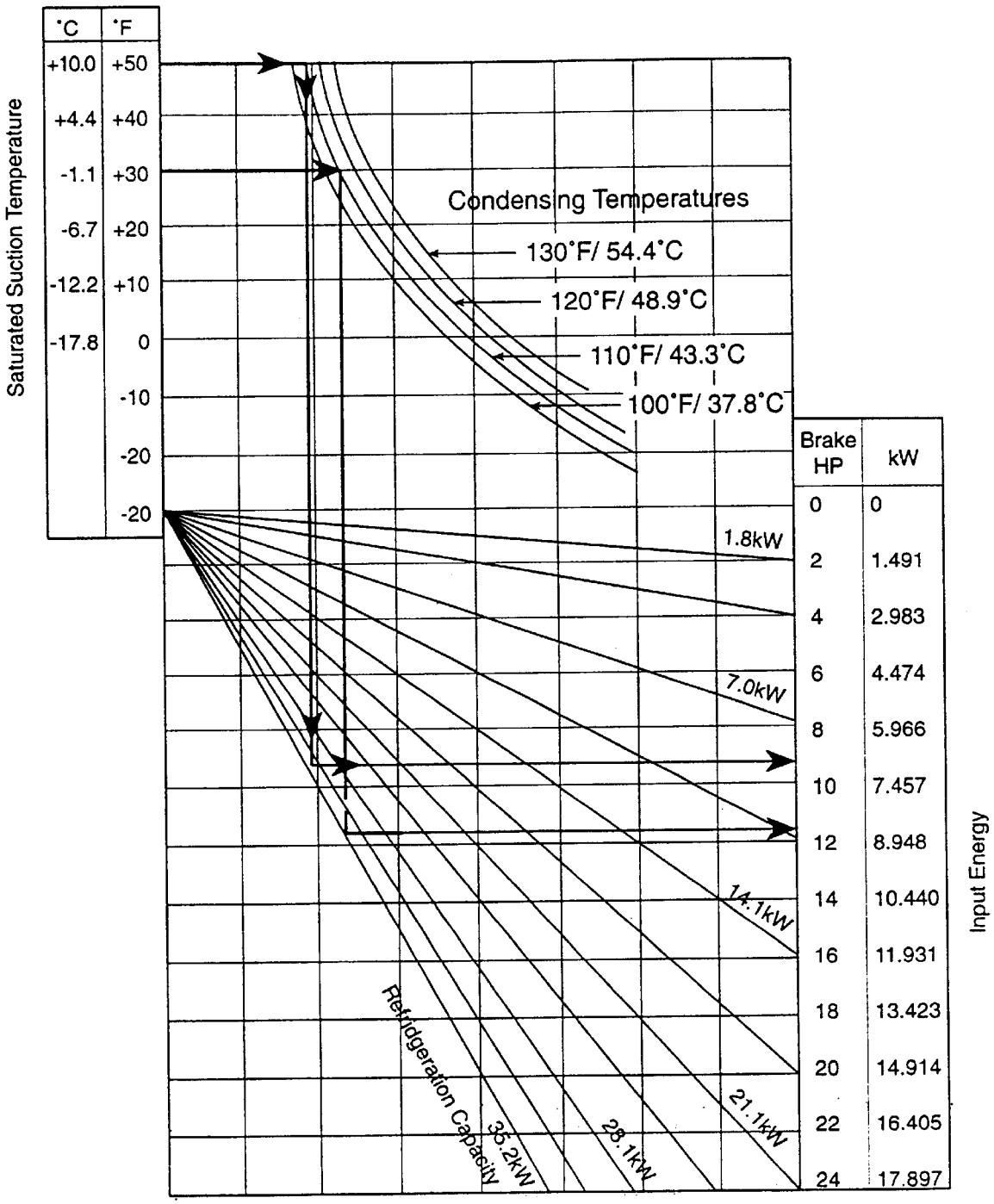
Figure 4:
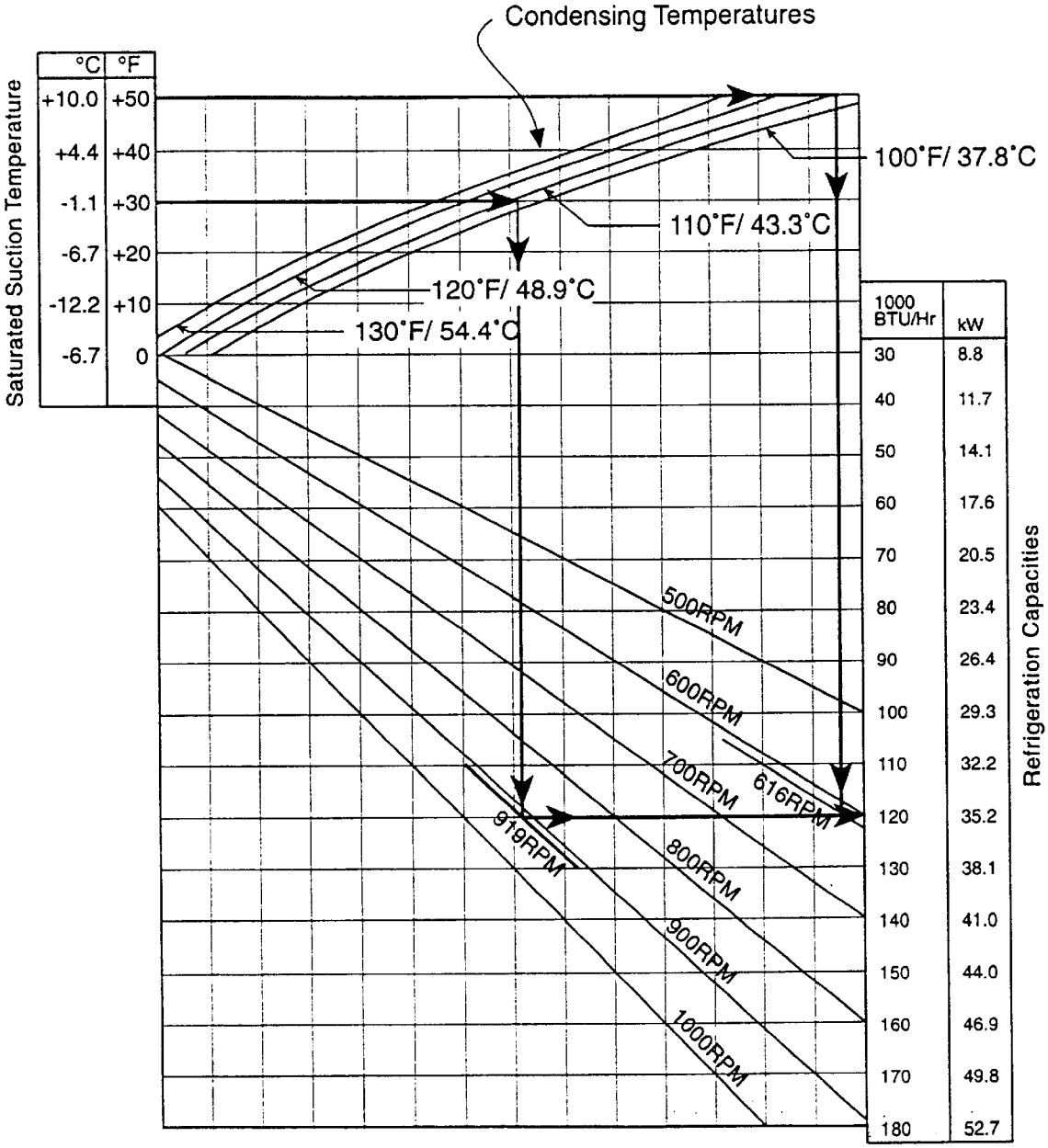
Figure 5:
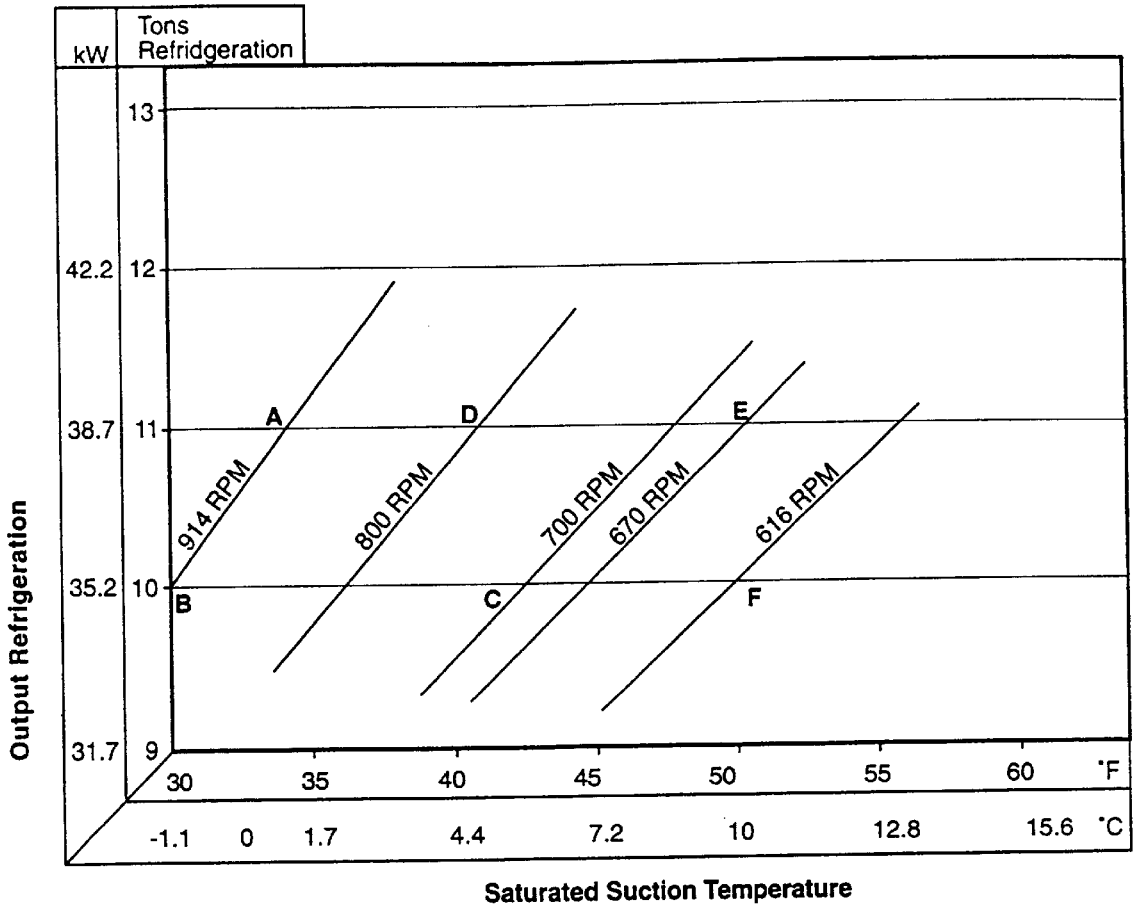
Figure 6:
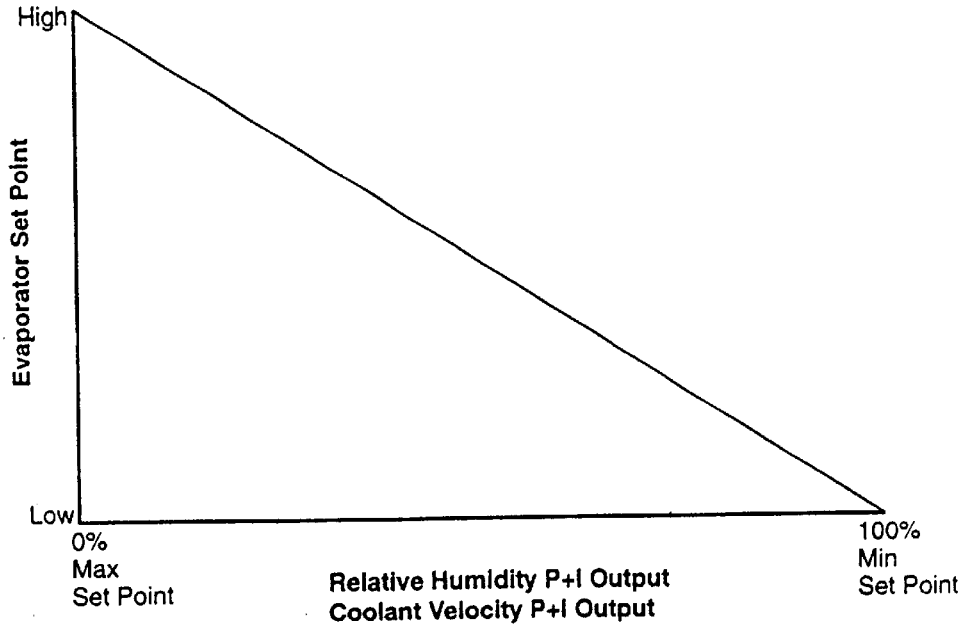
Figure 7A:
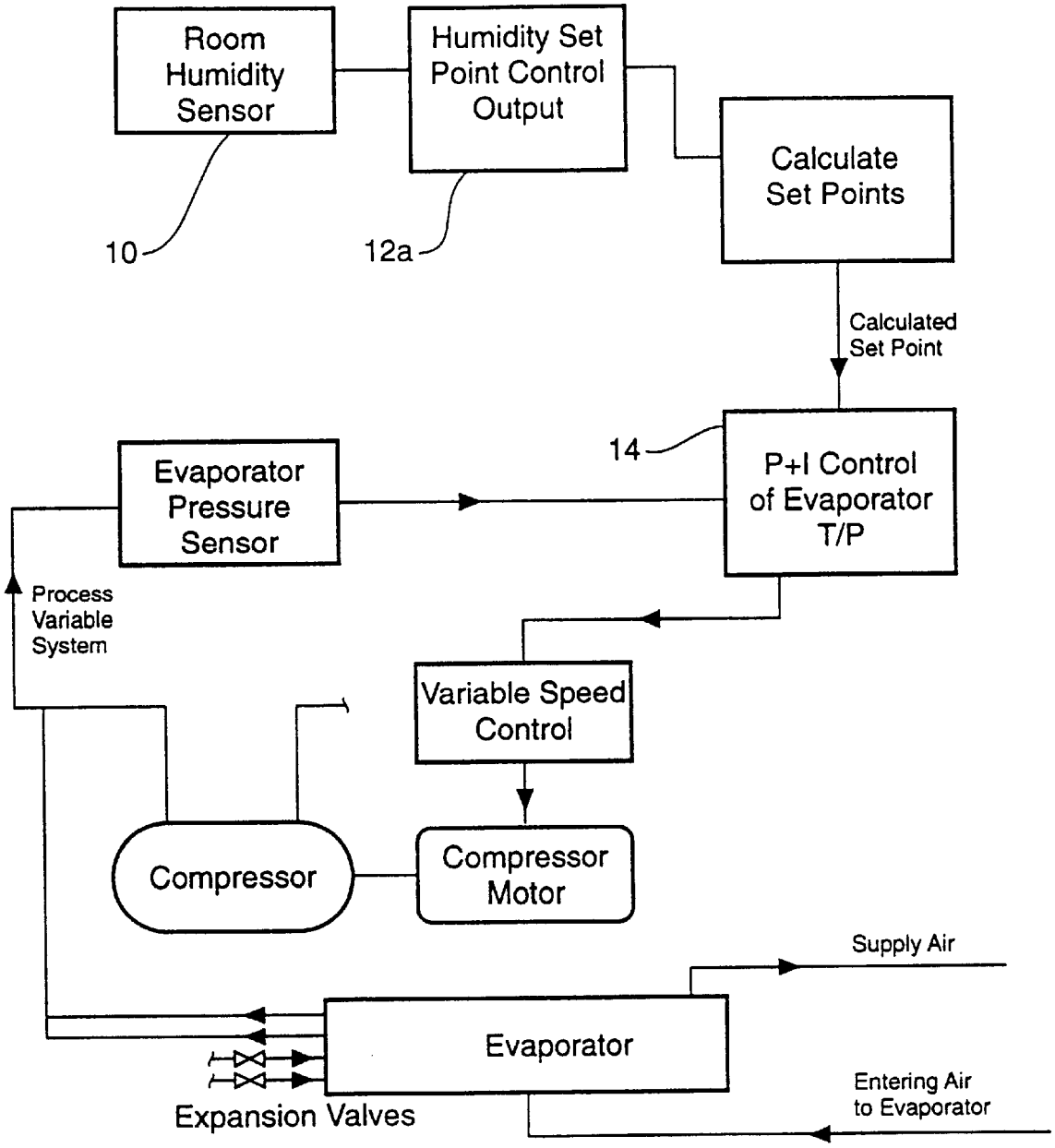

FIG. 3 is a compressor horsepower selector graph on which is compared a higher suction temperature, 10.0° C. (50° F.) with a lower suction temperature, −1.1 ° C. (30° F.) when the output refrigeration capacity is 35.2 kW (10 tons of refrigeration) or 120,000 Btu/Hr to indicate that there is a substantial reduction in the brake horsepower required by the higher suction temperature cycle. The higher suction temperature cycle requires only 9.1 horsepower, 6.8 kW, whereas the lower suction temperature cycle requires 11.4 horsepower, 8.5 kW, to deliver the same output refrigeration capacity of 35.2 kW;

FIG. 4 is a graph of compressor performance on which is related the higher suction temperature of FIG. 3 to a 616 RPM of the compressor and lower suction temperature of FIG. 3 to a 914 RPM of the compressor when an open reciprocating compressor of this embodiment is compared for the same output refrigeration capacity of 35.2 kW (10 tons of refrigeration) or 120,000 Btu/Hr;

FIG. 5 is a performance diagram derived from FIG. 4. It points to the means by which the control system automatically selects the highest admissible evaporator temperature through regulating the RPM of the open compressor in this embodiment of the invention. It is through this means that both reduced energy input is assured while maintaining the treated space conditions to high engineering performance standards. FIG. 5 will be discussed in detail under section describing the control system;

FIG. 6 shows the controllers Set Point Diagram which constrains the evaporator temperature to either a maximum acceptable Humidity Set Point or maximum Coolant Velocity Set Point, whichever is the higher of the two values and thus achieves reduced energy input to the refrigeration plant by establishing the highest evaporator set point while maintaining high standards of performance;

FIG. 7*a* represents a block diagram of the Control System of this invention when the evaporator coil interfaces directly with the airstream.

Figure 7B:
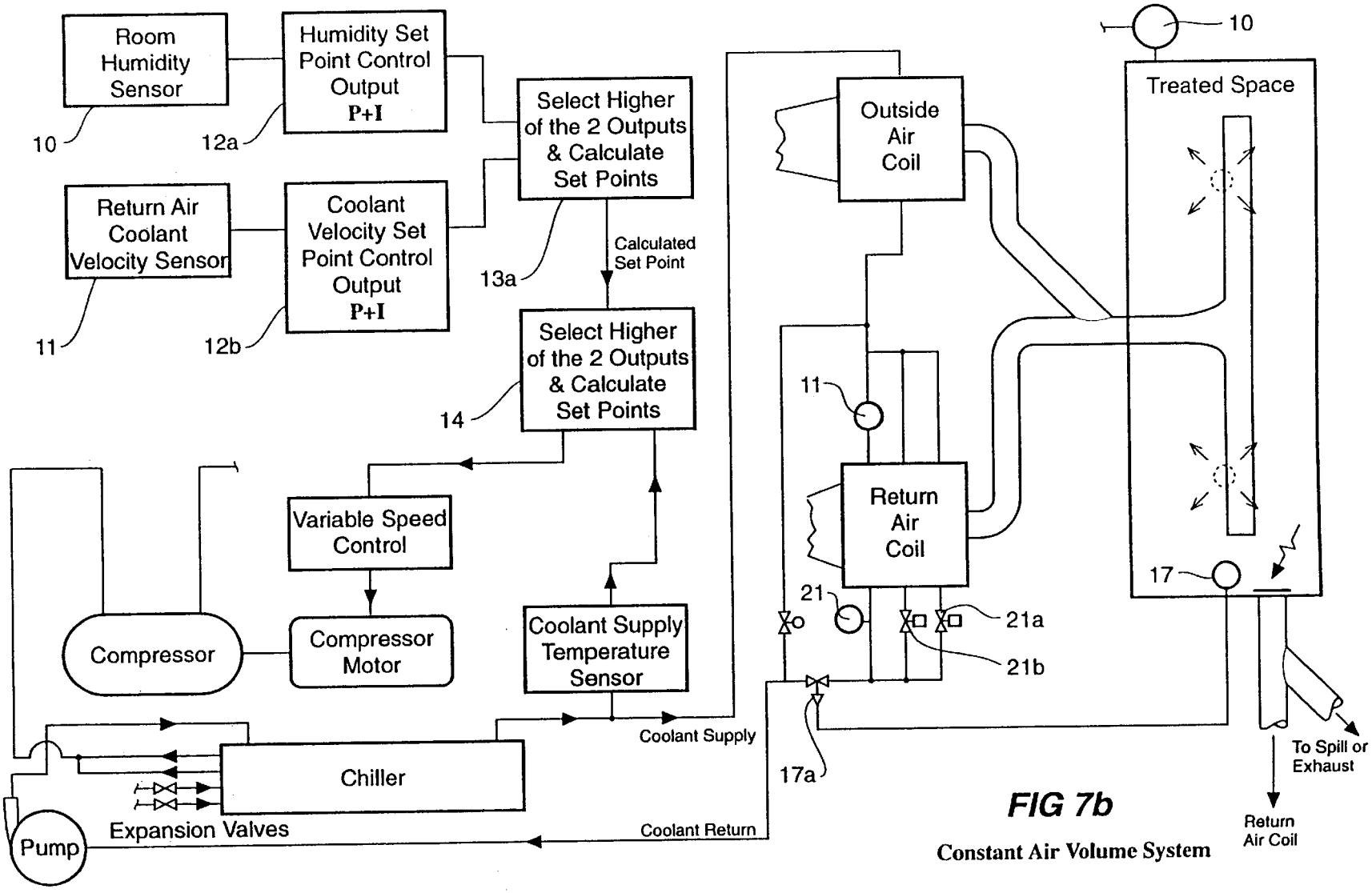
Figure 7C:
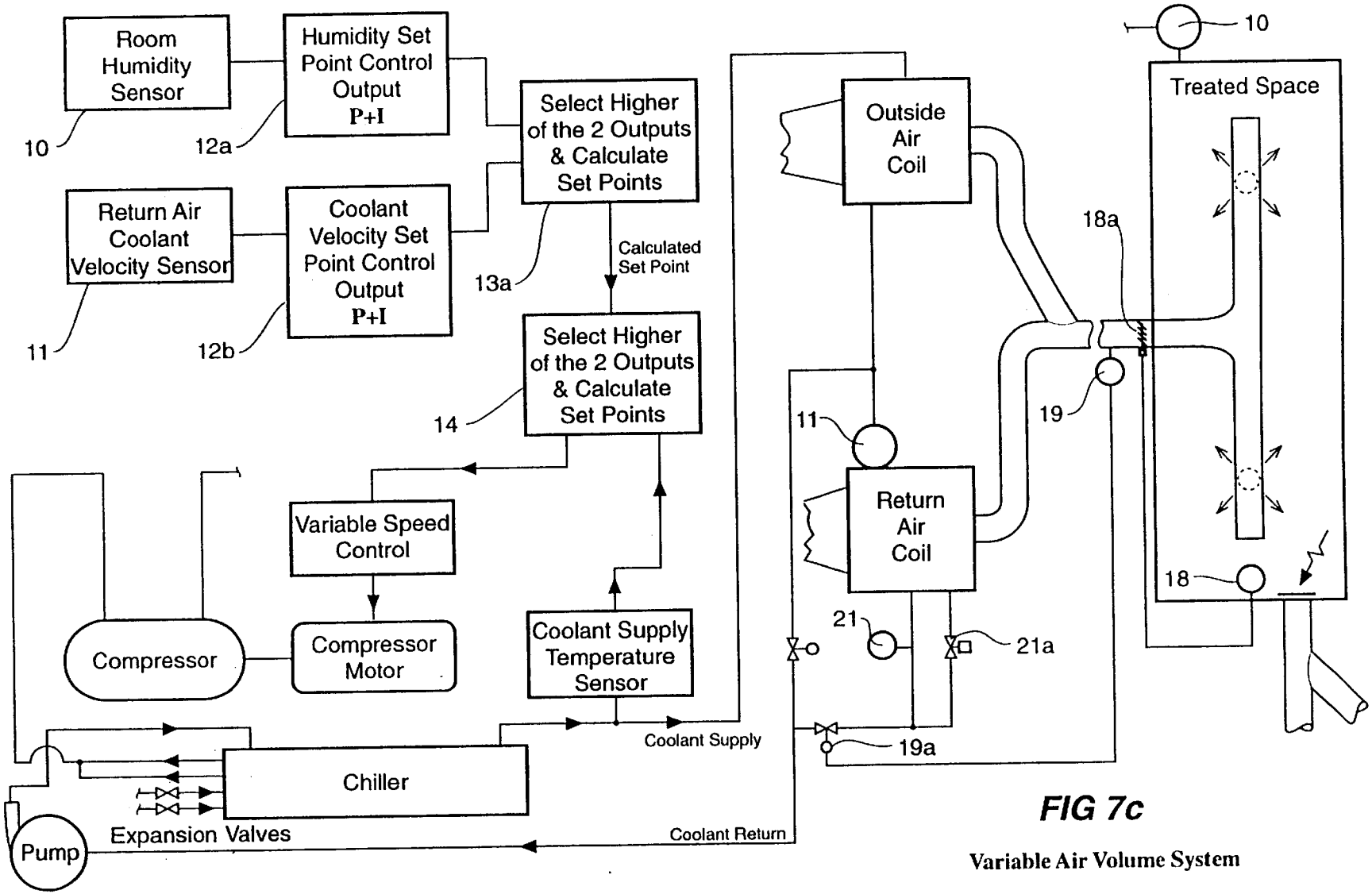

FIG. 7*b* is a block diagram of the invention's Control System linked to a constant air volume system employing a chiller. The range of the system from peak to minimum heat load performance is wide, requiring 3 stages of active coil sizes so that they are compatible with the sizes of the heat and moisture loads;

FIG. 7*c* is a block diagram of the inventions Control System linked to a variable air volume system employing a chiller. Cooling coil sizes are also indicated for a wide grange in FIG. 7*c*. Table 5 only indicates data for a fixed 4 row deep coil and a two row coil. The range of the Variable Air Volume system is limited because the supply air temperature is controlled to a fixed lower dry blub temperature whereas the supply air temperature in the Constant Air Volume system is a variable.

Hence the variable air volume system is limited to only one changeover otherwise the variable air volume flow rate of the supply air could be too low for good performance during low total heat loads.

The variable air volume system range is limited so as not to reduce the supply air flow to the treated space below approximately half of the peak air flow required in order not to do away with the Coanda Effect. However it is possible to enlarge the range further by changing to a constant air volume system.

FIG. 8 indicates psychrometric chart sketches of 2 different cooling coil systems.

FIG. 8*a* top and bottom sketches represent a design employing a separate outside air coil with a separate return air coil. The two FIG. 8*b* sketches represent a design employing a single coil handling the mixture of outside air and air returning from the treated space. This single cooling coil design is very commonly employed in temperate climates though it is often misused. Single coils which serve both outside air and return air conditions can not always treat economically with large differences between the nature of the outside air and the return air sensible and latent heat loads.

FIG. 8*b* top represents the case for a high outside air humidity which requires a low temperature coolant to offset the latent heat load, whereas return air from the treated space has a low room sensible heat load and a high room sensible heat ratio would be satisfactorily offset by a much higher coolant temperature and coolant velocity. The problem is exacerbated by the fact that usually the outside air is but a small fraction of the total supply air to the treated space. It is a very high energy penalty to unnecessarily have to employ a low temperature coolant for all the air. This energy penalty due to the over-cooling may then require reheating to prevent over-cooling of the treated spaces particularly since the occupants are dressed in their summer attire.

Furthermore the low coolant temperature may reduce coolant velocity below turbulent flow.

FIG. 8*b* bottom, on the other hand demonstrates in sharp contrast the energy that is saved when a treated space has a high room latent heat load while the outside air humidity ratio is below that of the supply air temperature. This combination drives the control system of this invention to increase the coolant temperature and offset the room latent heat loads at no energy cost by the low humidity outside air mixing with the return air prior to passing through the single coil.

Figure 10:
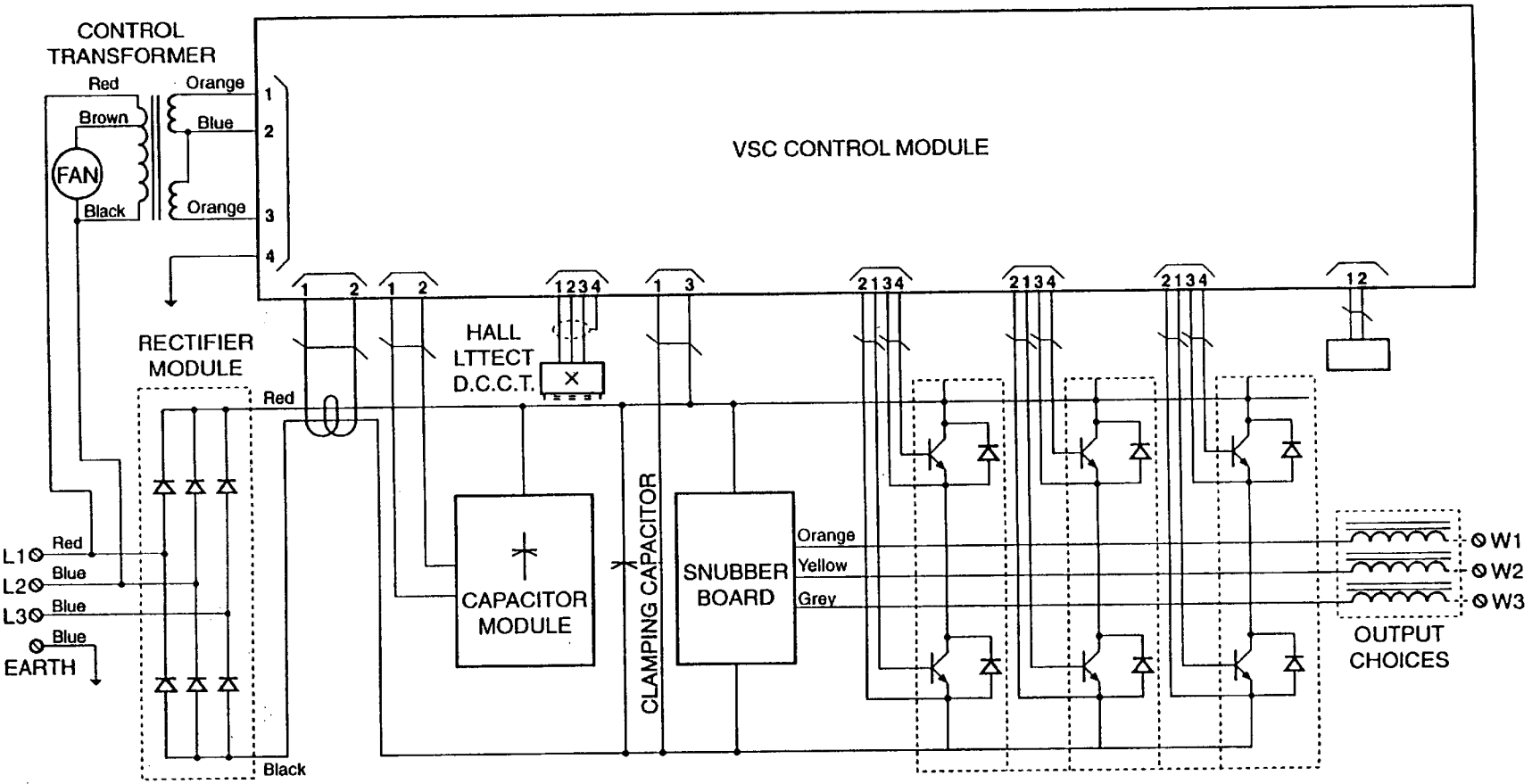

FIG. 9 presents Weather Bureau Data for Singapore and Adelaide respectively, marked by curves establishing ambient design loci for dry bulb day time temperatures. They are displayed together to indicate two very differing climates in their moisture content which can be handled by the same air conditioning design system of this invention when the overall total refrigerating capacity is the same; and FIG. 10 is a diagrammatic representation of a variable speed control module.

This invention has been written on the assumption that the standards of the American Society of Heating, Refrigerating and Air conditioning Engineers Inc, ASHRAE, will be observed and also the following limits apply. The control system allows designers to select their preferred operating conditions within the range provided by these standards.

Relative Humidity Maximum 60%
Relative Humidity Minimum 30%
Cooling Coil Chilled Water Velocity Maximum 2.7 m/s
Cooling Coil Chilled Water Velocity Minimum 0.15 m/s
Ventilation IAQ (depends on various factors) ASHRAE 62-1989
Coolant Supply Temperature 6° C. to 17° C.
Evaporator Temperature −1.1° C. to 15° C.
Air Pressure Drop Through Cooling Coils Maximum 200 Pa
Air Face Velocity Maximum 3 m/s
Chilled Water Pressure Drop Maximum 60 kPa Compressor speed minimum and maximum variable, determined by manufacturer.

In the event that these limitations above are not to control the equipment parameters as for example when relative humidity may be permitted to rise to 70%, the energy savings would be greater than if the upper limit of 60% is observed. The employment of this invention with such a variation will be considered an infringement of this patent.

In this embodiment of the invention the design is achieved by regulating the compressor speed to obtain the highest evaporator temperature that is compatible for each specific condition of heat and moisture load over the full operating range. This embodiment of the invention employs an open positive displacement reciprocating compressor with variable speed control (VSC) to relate to performance at all outside air and internal heat and moisture load conditions. See FIG. 10. The cost and size of modem variable speed equipment is competitive in this application.

The important influence in obtaining maximum energy conservation through this system occurs when the control system acts to establish a high evaporator temperature as for example by means of regulating the compressor RPM. The pressure-enthalpy diagram of FIG. 2 relates to a standard refrigeration cycle. When the evaporator temperature/pressure is raised the performance of the cycle moves up from the refrigeration effect of h1–h4 to h1'–h4'. This relates to the output refrigeration capacity required to offset the heat and moisture loads.

The energy input required to achieve this is the work of the compressor. When the evaporator temperature pressure is raised the work of the compressor per unit mass of refrigeration through the compressor is reduced by the difference between the value of (h2–h1)–(h2'–h1').

Figure 2:
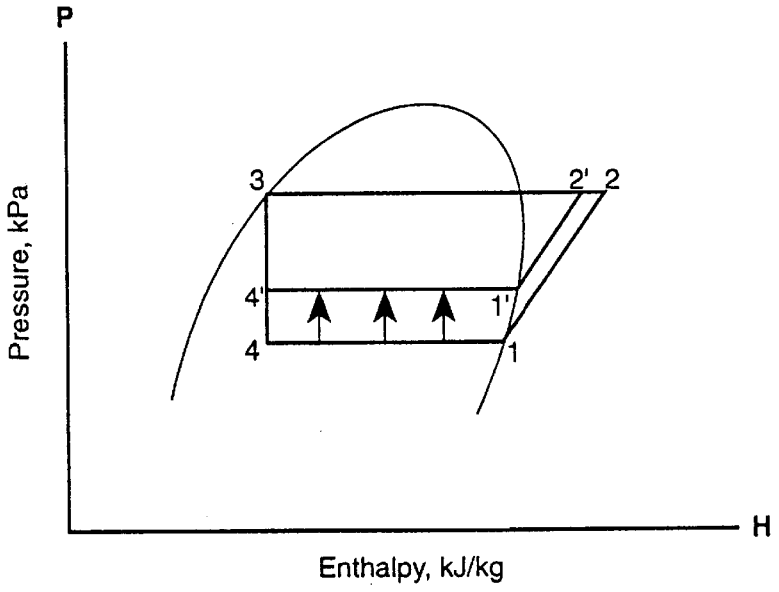
FIG. 2 shows this pressure enthalpy diagram to demonstrate the higher evaporator temperature/pressure that can be achieved through this invention over numerous conditions over its operating range and thus substantially reduces the enthalpy difference across the compressor.

Under conditions of a constant compressor RPM a fall in load would send a signal to the expansion valve of FIG. 2 to throttle the refrigerant to a lower pressure. One example is indicated in FIG. 5 where condition A moves to B, resulting in an unnecessary excess input refrigeration capacity for this refrigeration requirement This path is precisely opposite to the purpose of this invention, wherein energy is saved through the increase of the evaporator temperature and the decrease in the compressor pressure differential when A moves to C. This is best understood through the term COP (coefficient of performance) for this ratio, refrigeration effect is the numerator and the enthalpy difference across the compressor is the denominator $$COP = \frac{\text{Output Refrigeration Capacity}}{\text{Input Refrigeration Capacity}} = \frac{\text{Useful Cooling \& Dehumidifying}}{\text{The Work Necessary to Achieve this}}$$

Often there is a failure when evaporator temperatures and coolant temperatures are not controlled to be compatible during many variable simultaneous conditions arising over the climatic range. In this embodiment the problem is resolved.

The Capacity Control System

Reference is now made to the control system, illustrated in FIGS. 6, and 7*a, b, c.* The benefit of energy savings is accessible to each combination of heat load occurring over the full operating range according to the control system described below:

The control system comprises the essential components of room humidity control and coolant velocity control, each generating an evaporator pressure set point that is a point at which the evaporator pressure will be as high as the particular design condition in the range permits to minimise input energy and maintain high standards of performance.

The individual control outputs are proportional plus integral that continuously readjusts the output value to obtain either of the two input signals at a specified maximum value.

The higher of the two output-values at any instant is the required set point to achieve minimum energy input to the refrigeration plant The higher value is under-lined in both Table 1 and Table 5.

FIG. 6 is a Control Vs Set point Diagram and FIG. 7 is a Block Diagram of Control System.

FIG. 7*a* represents the simple case where the evaporator interfaces directly with the treated air. FIG. 7*b* describes a system employing a chiller in association with a constant air volume system. The return air coil his active stages. FIG. 7*c* describes a system employing a chiller in association with a variable volume system. The return air coil has 2 active stages. FIG. 7*b* relates to the performance reported in Table 1, FIG. 7*c* to the performance in Table 5.

Through this control system the means are imparted to automatically select whether the evaporator temperature should rise or fall.

In FIGS. 6, 7*a* and 7*b* a humidity sensor 10 is located within the treated space, and a coolant velocity sensor 11 in the cooling coil circuit which is always active when the coil is in operation. Each is associated with a respective set point 12*a* and 12*b* which imparts limits on the values as described above. They are then fed to a discriminating device 13 which is responsive only to the higher of the two signals, and adjusts the evaporator pressure 14 or chiller control 14 in this embodiment to provide an evaporator pressure which maintains the higher of the two set points at Its maximum set point condition. This constitutes a proportional control plus integral action. The sensors may be electrical, pneumatic or hydraulic, or any combination thereof. For example, if electric the device 13 may need to be only diodes. If pneumatic, device 13 may be, for example, a Honeywell selector relay RD405. The arrangement is essentially of mathematical functions, and need not comprise separate discrete devices.

A microprocessor may be used to achieve the same functions. A room thermostat 17 with valve MV17*a* is indicated for Constant Air Volume System, (FIG. 7*b*). A room thermostat 18 associated with a damper 18*a* plus a supply air thermostat 19 associated with valve MV19*a* are indicated for Variable Air Volume system (FIG. 7*c*).

In comparing energy requirements for different COP values, the percent of greater input energy required by the lower COP value over that of the higher COP value when relating to the same output refrigeration capacity is determined as follows:

If the lower COP=2 and higher COP=3 per cent of additional energy required by COP=

$$\frac{100(COP = 3\text{-}COP = 2)}{COP = 2} = (100)(3\text{-}2)\Big)\Big/2 = 50\,\%$$

50% more input energy for COP2

A higher evaporator temperature reduces heat transfer across the heat exchangers. In the case where there is a chiller supplying a cooling coil interfacing with the treated air there is a corresponding rise in the coolant temperature which is offset by conventional controls. A conventional modulating valve 17*a* opens to increase the coolant flow through the cooling coil, thus maintaining the treated space dry bulb temperature at its design setting 17 in the case of the constant air volume system FIG. 7*b*.

Also a conventional modulating valve 19*a* opens to increase the coolant flow in the case of the variable air volume system, FIG. 7*c* thus maintaining the supply air dry bulb temperature at its design setting 19. In conjunction with this a room thermostat, 18 regulates the supply air flow through the air damper, 18*a* to control the air flow rate to be compatible with the room dry bulb temperature.

The higher evaporator temperature causes a rise of humidity in the treated space. The control system described above and illustrated in FIGS. 6, 7*a*, 7*b* and 7*c* prevents it from rising above a humidity design set point and a coolant velocity set point. In this manner the control system provides the maximum COP and the least Input Refrigeration Capacity compatible with performances at good engineering standards.

In the case of a direct expansion air conditioning system where the evaporator interfaces directly with the treated air in lieu of the secondary coolant velocity set point a minimum speed control set point is supplied within the Variable Speed Control Device.

When there is a fall in output refrigeration capacity there is not necessarily a fall in compressor speed and a rise in evaporator temperature as is indicated in FIG. 5 in the change from point A to C, though, this direction is preferred from the point of reduction in input energy. For example, a fall in output refrigeration capacity from set point E at 670 RPM may find the control system signalling for a rise in the compressor RPM to 700 RPM and a reduction in evaporator temperature as is indicated in a change to point C, or it may signal for a fall in the compressor RPM and a rise in evaporator temperature to point F at 616 RPM. Similarly a rise in output refrigeration capacity may require either a fall or rise in the compressor RPM as from point C to E or C to D in FIG. 5.

The system according to one or more embodiments is to respond to the simultaneous needs for heat and mass transfer and automatically select a correct choice of compressor speed to offset both the sensible and latent heat loads at each condition over the full operating range and to do so at minimum energy input.

For a given load a rise in evaporator temperature is indicative of a condition wherein both the space humidity and the coolant velocity are below their design set points. A fall in the evaporator temperature is a response to a signal to either increase dehumidification or decrease coolant velocity.

This system of air conditioning is compatible with other compressor systems as well as the system of compressor speed adjustment as described in this embodiment selected to demonstrate this invention. See FIG. 10 for the diagram of the variable speed control module.

These other systems include:

(a) Rotary Screw Compressors equipped with sliding valves for capacity control. These have large capacity coverage but there is some loss of efficiency in capacity reduction.

(b) Open centrifugal machine having automatic speed control from steam and gas turbines. Control of surging is a factor here.

(c) Centrifugal Compressors with pre-rotating vanes.

(d) Multiple flow temperature systems are also to be considered.

Reduction of condensing temperature, staging and flash gas removal are compatible with the system.

An objective is efficient compressors exhibiting high coefficients of performance wherein the evaporator temperatures can be maintained as high as treated space humidity and coolant flow conditions permit. To meet the system conditions the evaporator temperature is a variable and the temperature of the coolant chilled water or brine, etc is also a variable as demonstrated in the embodiment of this invention, as illustrated in Tables 1 and 5. Reference is also made to a section hereunder on zoning which relates to the coolant temperature variations.

In the embodiments presented here in Table 1 and Table 5 a single peak size range of approximately 28 kW is presented. However any size range can be developed having the same performance characteristics. Thus a consulting engineer or a manufacturer can develop a complete line of coverage for all size ranges.

For example employing the range selected here as a datum, the range can be doubled by simply doubling the width of the heat exchangers and doubling the number of circuits to maintain the same coolant velocity range and coolant pressure drop range. Obviously the treated air face area has also been doubled maintaining again the same face velocity and the same air pressure drop. Similarly the number of vertically spaced tubes could be doubled and again number of circuits doubled thus in combination with the doubled width the datum size range has been quadrupled. By similarly halving width, halving tube height of the datum size results in a total of seven size ranges from minimum to maximum. Thus a universal system covering all desired sizes can be formed.

In a system which is sensitively responding to room sensible and latent heat loads to reduce energy input it is useful to consider the matter of zoning in applications such as high rise buildings. In most buildings simultaneous variations in Room Sensible Heat Ratio are not very large. In these cases small differences can readily be handled by selecting the maximum humidity set point of the control system about 2% lower in terms of relative humidity than would be necessary for a single zone system. For example a set point of 58% RH(relative humidity) would prevent conditions which would allow a rise in its RH to 60% in the area where the RH is not sensed.

A Humidity Economy Cycle

First let it be clear this is not a Conventional Economy Cycle though it could lead up to one there is no increase in the outside air intake required for this humidity economy cycle to function. The conditions encountered by the cooling and dehumidifying coils vary very much over a climatic range. There are numerous occasions where energy can be reduced by preventing dehumidification by the refrigeration system.

For designers identifying economy cycles as associated with reducing sensible heat loads it may appear unusual to find that through this invention, an economy cycle can occur at outside air conditions as high as 35° C. dry bulb temperature. Furthermore no special requirement or control is necessary. It occurs automatically in this system to result in a large reduction of both output and input refrigeration capacity by offsetting all or part of the treated space latent heat loads by preventing the refrigeration cycle from dehumidifying to offset the treated space latent heat loads when dehumidification can be achieved naturally during low humidity outside air conditions which is at the flow rate determined by ventilation purposes.

A "humidity economy cycle" can be a part of the system during non-humid weather when the outside air is below the dew point of the supply air, the inlet and outlet refrigeration capacities can be reduced well below present practice. Conventional design pays little attention to energy conservation during dry weather even though it is a condition that occurs frequently in many climates.

The coolant temperature is determined in accord with this invention by the capacity control system which selects the value of the coolant velocity or the room humidity to obtain an output set point value. This results in a coolant temperature that is too high for the refrigerant to dehumidify. During non- humid weather high coolant temperatures exceeding the dew point temperature of the supply air to the treated spaces will often occur. Consequently dehumidification from the supply air by the refrigeration system will be prevented. Thus the latent heat loads of the treated spaces would be offset at no energy cost since under such conditions the cooling coils are dry. Tables 3 and 4 indicate the case of a zero latent heat load penalty on the refrigeration system. Tables 3 and 4 indicate in detail the performance of the humidity economy cycle during an outside air dry bulb temperature of 30° C. Table 3 details performance at an average room latent heat load bearing a Room Sensible Heat Ratio of 0.85 and Table 4, at a very high room latent load having a Room Sensible Heat Ratio of 0.70. This "Humidity Economy Cycle" is relevant for both the arrangements of this embodiment where a separate return air coil and a separate outside air coil is employed, (FIG. 8*a*) or in the simpler arrangement where the return air is first combined with the outside air to pass through a single coil, (FIG. 8*b*). However single coil design is limited to only low humidity outside air climatic regions as is indicated in detail under discussions regarding FIG. 8*b*. The cycle will always occur as long as the supply air to the treated space has a dew point temperature above the temperature of the outside air which mixes with return air. In Tables 3 and 4, high coolant temperatures of 14.2 C. and 13.0 C. are indicative of not only a savings of refrigeration capacity to offset room latent heat loads but also to increase the COP of the system and thus considerably reduce the input energy to the refrigeration system.

Modifying the system to carry out the invention has the advantage of also providing a means for automatic reduction of output refrigeration capacity:

The design engineering standards for comfort air conditioning accepts room humidifies over a wide stipulated range. In accord with this invention, it is preferred to select the design humidity set point of the control system at or near the high side of this range. This results in a higher enthalpy value of the air leaving the cooling coil and to a reduced enthalpy difference. For example on a 35° C. dry bulb temperature day Table 2B indicates a rise in relative humidity to 58.8% at a chilled water supply temperature of 11° C. Table 2B indicates that when this performance is compared with the 49% room relative humidity room at a chilled water supply of 7° C. there is 10.5% greater output refrigeration capacity required by the conventional chilled water supply temperature from a chiller.

In the "The Capacity Control System" section above, reference was made to a horizontal line in FIG. 5 which represented a line along which the Capacity Control System locates the balance point for a particular operating condition in the air conditioning range. However where there is a reduction of output refrigeration capacity this line slopes down to the right reflecting the reduction in output energy as the relative humidity within the treated space rises to a higher set point. This fall in the output refrigeration capacity again further reduces the input energy of the compressor.

A further advantage is that the cooling coil can have an increased range of cooling which resolves unstable flow conditions:

This is a further advantage when working to higher evaporator temperature conditions when coolants such as chilled water are employed. As is commonly the case with conventional systems coolant flow rates through coils fall drastically at part load conditions. Numerous tests indicate that in most cases the Reynolds number and water velocity changes from desired turbulent flow to unstable transition flow is at a point of about 30% to 50% below peak load. In the case of this invention the range of the cooling coil size is enlarged. This occurs as a result of the rise of the evaporator temperature which causes a greater demand for the warmer coolant as is indicated above in the section relating to reduction of input refrigeration capacity. Accordingly, the range of the coil is enlarged. In Table 2A the part load condition for the return air coil water velocity is 0.35 m/s when the chilled water supply temperature is 7° C. This condition occurs here at 62% of the total peak load when the chilled water velocity is approaching its minimum 0.2 m/s value. For the identical system part load condition, when the chilled water supply temperature is 11.2° C., the chilled water velocity is 2.26 m/s. The invention enables performance to be tailored for each operating condition with each design having broad climatic coverage. There are further advantages in addition to energy conservation. In the process of maintaining the highest evaporator temperature for each individual operating condition it overcomes contradictions arising from many unrelated variables. The compressor is compatible with its refrigeration cycle. The variation of size of the heat loads is compatible with the variation in compressor RPM. A new sensitivity to each specific operating condition is gained.

The above advantages have been found to be extendable to cover different climatic areas using the same design. A VAV system is presented hereunder which covers many different climatic ranges having widely different room sensible heat ratios. Humid, tropical Singapore and hot, dry Adelaide can be served by the identical selection. The difference becomes evident when reference is made to psychometric charts displaying for Singapore and Adelaide, FIG. 9 conditions for ambient design loci exceeding 10% of operating hours for day time. An examination of the respective humidity ratios for these areas reveal how their design conditions are very dissimilar. The humidity ratio for Singapore design locus is between 21 and 22 g/kg. The humidity ratio for Adelaide is between 10 and 12 g/kg/. The broad coverage of this design is such that these two very dissimilar climates are efficiently served by the identical selection without any energy or performance penalty as long as both systems are compatible with the range of sizes of the heat loads and the ratio of outside air to total supply air to the treated spaces.

In Table 5, row b represents peak Singapore condition and row e represents peak Adelaide condition.

The energy conserved through this invention involves consideration of performance of a system over its full operating range. To meet this purpose, numerous representative conditions for tropical and temperate climates have been studied. There is no single answer to how much energy is saved since it involves comparisons with numerous conventional systems having different energy and performance characteristics. Furthermore each climate has different lengths of peak and part load needs. For example a dry climate would have the enormous advantage of the humidity economy cycle described above whereas a tropical climate would have a cooling season that covers the full year of which 25% of the time it is below 27° C. dry bulb temperature when the coolant supply temperature would rise from 7° C. to above 10° C. when this invention is applied.

Data for open type reciprocating compressors are used hereunder to assist in an appraisal of the invention. This is taken from a reliable publication, the "Terry Engineering Manual for Belt Driven Equipment". Reference is made to two Terry performance graphs drawn for R22 Refrigerant, FIG. 4, (Terry FIG. 15E) and FIG. 3, (Terry FIG. 21). Comparison is made with the performance at an evaporator temperature of −1.1° C. (30° F.) with that of an evaporator temperature of 10° C. (50° F.) when in both cases they serve the same Output Refrigeration Capacity of 35.2 kW, (120, 000 Btu/Hr or 10 tons of Refrigeration. The condensing temperature will be assumed as constant at 43.3 C. (110 F.). From FIG. 4 (Terry FIG. 15E), follow the arrow from the upper set of curves to the lower set ending at the value of 35.2 kW, (120,000 Btu/Hr). The RPM of the compressor at 10 C. (50 F.) evaporator temperature is 616 and for −1.1 C. (30 F.) run, it is 914. These variations in RPM are within the manufacturer's approved limits.

FIG. 3 (Terry FIG. 21), will now indicate the input energy that the two runs required to satisfy the Output Refrigeration Capacity of 35.2 kW, (120,000 Btu/Hr or as listed in the FIG., 10 tons of refrigeration). Enter the upper graph ordinate at 10 C. (50 F.) and −1.1 C. (30 F.) and move to the 43.3 C. (110 F.) curve condensing temperature line. Move down to the lower graph Output Refrigeration Capacity value 35.2 kW (10 tons of Refrigerant is what is listed in the graph). Now continue to the right ordinate where "Brake Horsepower Required" is indicated.

The 10 C. (50 F.) evaporator temperature run has an input power requirement of 6.7 kW (9BHPP) and a COP =5.24, the −1.1 C. (30 F.) evaporator temperature run has an input power requirement of 8.5 kW, (11.4 BHP) and a COP =4.14.

The energy Input Refrigeration Capacity for the −1.1 C. (30 F.) run is 26.7% greater than the 10 C. (50 F.) run when handling the same heat loads. Few designers are aware of the enormous energy savings achieved through a higher evaporator temperature.

The above results can also be indicated on the capacity versus evaporator temperature plot of FIG. 5 which is derived from FIG. 4. Consider a conventional hermetic reciprocating compressor operating at a fixed RPM of 914 serving a higher heat load at some point A of FIG. 5. On a fall of load to 35.2 kW the action of the expansion valve would be to throttle the refrigerant down the 914 RPM condensing unit line to point B, rather than in the case of this system where the control system would select the highest evaporator temperature which would offset the sensible and latent heat loads occurring at that instant, point C in this example, at 616 RPM and 10 C. (50 F.) unless one of the two capacity control set points are reached earlier.

SUMMARY OF ADVANTAGES

Tables 1 and 5 (CAV and VAV systems) indicate that in some prior art it is common for unstable flow conditions of coolant to exist at low flow rates.

It is common for air conditioning designers to fail to determine the details of performance over a range. These details have been partially displayed in Table 1, for a CAV system, and Table 5, for a VAV system. It is known that unstable performance can occur as discussed in the sections above regarding part load performance below 50% of peak load. A further example is illustrated in Table 5 run o representing a part load condition performing at a minimum acceptable chilled water velocity through the return air coil. This occurs at 0.2 rn/s and in this case is at a temperature of 9 C. The identical condition was repeated at run o0 at bottom of Table 5 representing a conventional system at 7 C. chilled water supply temperature. It has a water velocity of 0.1 m/s through the return air coil. This is at too low a Reynolds Number and is in transition flow which performs unstably.

The above is only one of many examples. There are other digressions from standard practice that similarly occur, often to overcome problems. An unacceptable solution is reduction of the outside air intake requirement for. ventilation. The use of desiccant wheels is an expensive replacement, and over-cooling and reheating is also expensive and considerable discomfort arises when reheating is omitted when all the air is overcooled to offset latent heat load when a single coil handles both the outside air and the return air flow quantities.

Clearly a comparative appraisal cannot be given here. Instead a range is presented referring to the percent of energy saved over the full climatic range of the cooling system. When at all conditions, engineering standards are satisfied, it is estimated that combined energy savings are in range of 40% to 60%, comprising:

(a) Input Refrigeration Capacity Control System which maintains an evaporator temperature as high as feasible including the humidity economy cycle.
10% to 26%

(b) Output Refrigeration Capacity Reduction (based on humidity set point in treated space being maintained high in the acceptable performance range through increase of the evaporator temperature an increase of chilled water supply temperature).
5% to 12%

(c) Output Refrigeration Capacity Reduction (based on humidity economy cycle) with reduction of the energy required to offset the treated space latent heat loads even during very high outside air dry bulb temperatures.
5% to 20%

(d) Based on the arrangement of the components, their sizing and circuiting so that the cooling and dehumidifying surfaces perform efficiently in order to maintain an evaporator temperature as high as good engineering standards permit.
20% to 40%.

(e) The control system of this invention offsets only the heat and moisture loads occurring simultaneously. Furthermore when we relate to energy requirements of conventional systems we must make allowance for the correction of the energy employed by these systems under conditions of satisfying performance standards as we do in this invention. Therefore a correction factor is applicable which has a highly variable range depending on the conventional system employed. For example a single coil treating both a relatively high humid outside air and low latent heat return air together where all the air must be cooled to a low enough temperature and then reheated to maintain acceptable treated space dry bulb temperature.
10% to 50%

(f) Savings occur when at low heat and moisture loads in the range the active size of the cooling can reduce to efficiently fit a lower heat load range.
5% to 15%.

Obviously the factors listed above in a to f are not additive. As indicated above, estimate that energy savings will be approximately within the 40 to 60% range is conservative. In those cases where a single coil serves both the outside air and the return air a saving of 80% is possible.

In addition there are capital cost savings, reduced design time, reduced service space, and performance meeting engineering standards over full range.

Further advantages include:

(a) All conditions which can occur at any point within the operating range are treated individually with an evaporator temperature and coolant supply temperature which is automatically determined for that particular condition.

(b) System performance which can be tailored to the individual conditions occurring extends the system capacity to handle a wider climatic range.

(c) System does not wastefully over cool or reheat at any time. The sensible heat and latent heat loads are offset in the proportion at which they occur.

(d) System when arranged according to this invention maintains coolant performance in turbulent mode and does not reduce coolant flow to the unstable transition mode.

(e) Simple controls are not invasive they perform as an over lay to existing control practice. They operate to improve energy savings for most conventional air conditioning systems.

(f) System adheres to high Engineering Performance Standards (ASHRAE Standards were applied in the described embodiments)

(g) The invention is compatible with VAV and CAV designs and with direct expansion air conditioning;

(h) The described systems do not intrude adversely on any acceptable conventional design as long as provision exists for variation to the evaporator temperature and coolant supply temperature the system of this invention will readily fit as retrofit for poor functioning systems. The system is user friendly, has universal application, reduces design time and is low in first cost when compared with conventional systems which also meet performance standards at all operating conditions from peak to minimum range.

In Summary

The energy savings go hand in hand with improved performance.

It has been demonstrated that by means of a control system associated with maintaining the maximum evaporator temperature compatible with high engineering standards of performance, the complex problems, which arise from the presence of numerous unrelated variables, have been resolved. These variables occur simultaneously and successively with the changes in outside air and internal sensible and latent heat loads. They can best be controlled when each point in time within the operating range is individually addressed.

In all cases where the system is employed the key objective is to maximise the evaporator temperature in order to conserve both Input and Output Refrigeration Capacity. In the embodiments described, an open type compressor was employed. The speed of the compressor is varied responsive to the Evaporator Temperature/Pressure Set Point. When heat and moisture loads fall or rise the speed is reduced or increased (not necessarily respectively) until either one of the treated space, maximum relative humidity design set points, or maximum coolant velocity design set points, is reached, whereupon the capacity control has efficiently established the balance point for that operating condition. In lieu of simply throttling the refrigerant to reduce the evaporator temperature on a fall of heat loads or other inefficient capacity control means, the balance point of the system is located at the highest evaporator temperature compatible with the heat and moisture loads occurring at that time. Thus assuring minimum input energy by the refrigeration compressor.

In this design the fluid flow characteristic of turbulent flow is maintained within performance bounds of a coolant velocity design maximum and minimum limit which varies the active size of the cooling coils to fit the size of the load in the cases where wide range occurs between peak and minimum loads.

A very important advantage is associated with the variations in coolant supply temperatures. The range of acceptable cooling coil performance between peak to minimum is very much increased.

Furthermore, the system has been shown to have the capacity to adjust its performance to suit each individual condition including variations in climate and room sensible heat ratio through the flexibility gained from having a variable coolant supply temperature and a variable evaporator temperature/pressure.

Input Refrigeration Capacity is a value not readily visible to designers. In this presentation the significance of a variable evaporator temperature and a corresponding variable coolant supply temperature has been presented. Systems employing stage compression, intercooling, flash gas removal and reduction of condensing temperatures are applicable to this invention. An important principle has been applied here and numerous advantages derived from the use of this principle to air conditioning design. By working to the highest feasible evaporator temperature (and thereby coolant temperature), compatible with good performance to achieves the lowest feasible energy input requirement. Many designers think that because they often employ low condensing pressure that they are achieving the same input energy savings as with an equivalent high evaporator pressure. Wholly apart from the fact that there is thermodynamically a greater energy savings with the increase of evaporator pressure with condenser pressure constant than is the decrease of condensing pressure with the evaporator pressure constant, the evaporation pressure in this invention is linked to the cooling and dehumidifying processes through a proportional plus integral control system which is key to the performance. As indicated above this system also can employ reduced condensing pressure.

DESCRIPTIONS OF THE PREFERRED EMBODIMENTS

Embodiments of the invention are described hereunder in some detail with reference to and are illustrated in the accompanying Tables and Drawings, wherein:

Table 1 indicates an example of performance over a range where the invention is applied to a constant air volume system utilising chilled water fed to an outside air coil first as described in detail above.

Table 2a compares the same sensible heat load conditions at different chilled water supply temperatures. Table 2a indicates a supply coolant temperature of 7*c* having a total output refrigeration load of 15.82 kW whereas at 11.2 C. this load is 15.25 kW a difference of only 3.6% saving. The total saving is not visible here since it depends on the input energy to the compressor. The saving is very much greater approximately 20 per cent when the input energy is considered. Perhaps this is the reason so little attention is given to maintaining a high evaporator pressure, a higher C.O.P.

Table 2b is a similar comparison to table 2a. It has a more visible savings of 10.6%. See analysis under section: "Reduction of Output Refrigeration Capacity" on page 25 part (c). In addition i has a high input energy saving due to its higher C.O.P.

Table 3 represents a Humidity Economy Cycle indicating a room latent heat load of zero energy penalty in offsetting the room latent heat losses. It indicates the effect of the capacity control system to drive the coolant temperature upwards in 8 steps, to achieve excellent performance when the chilled water temperature is doubled from 7 C. to 14.2 C. at a very much higher evaporator pressure resulting in a very much reduced input energy. Both energy savings in offsetting the total latent heat load without any energy penalty and input energy savings are realised. Unlike the conventional economy cycle, the outside air intake is not increased neither is the room relative humidity. The limiting factor is coolant velocity has reached it maximum design setting at 2.2 m/s in this case through the return air cooling coil.

Table 4 again indicates Humidity Economy Cycle similar to Table 3 with a very high room latent heat load that is again fully offset with zero energy penalty.

Table 5 indicates an example of performance over a range where the invention is applied to a variable air volume system utilising chilled water fed to an outside air coil first. The same comparison as for a constant air volume system as in Table 1. See conventional row o' performance compared with row o performance of invention under 'SUMMARY OF ADVANTAGES' above.

Figure 1A:
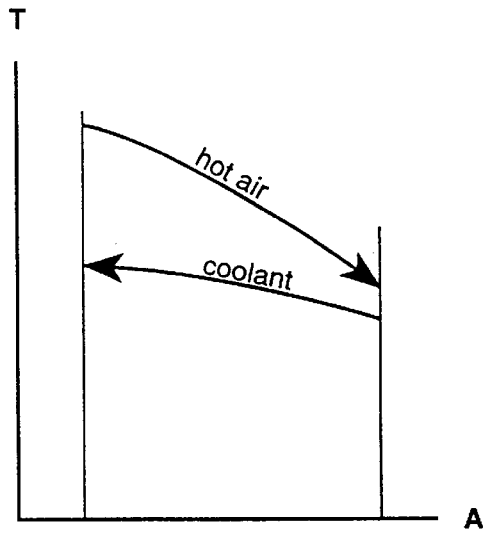
FIG. 1(*b*) represents a conventional outside air coil performance where the coolant supply flows in parallel to the outside air and return air coil.
Figure 1B:
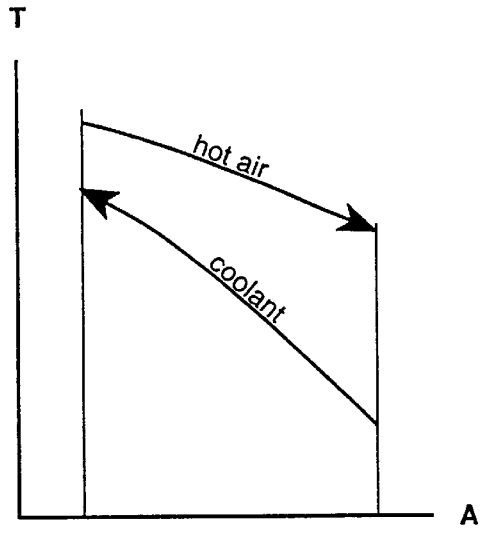

FIG. 1*a* compares the performance of the outside air coil in the arrangement of separate outside air and return air coils of this embodiment with FIG. 1*b* which represents a conventional outside air coil application.

FIG. 2 graphically shows how the raising of pressure (and thereby refrigerant temperature) can result in a savings of energy.

FIG. 3 shows graphically how an increase in suction temperature from −1.1 C. to 10 C (30 F. to 50 F.) can reduce the Brake Horsepower Requirement by some 26.7%.

FIG. 4 can be read in conjunction with FIG. 3 and illustrates how the compressor speed for the −1.1° C. (30 F.) condition is 914 RPM and for the 10° C. (50° F.) Condition it is 616 RPM for the same refrigeration capacity load of 35.2 kW (10 tons of refrigeration).

FIG. 5 which is derived from FIG. 4, illustrates the savings that can be achieved under conditions of increased suction temperature for the same refrigeration output.

FIG. 6 is a graph showing how treated space humidity proportional plus integral output set point and coolant velocity proportional plus integral output set point will generate a high evaporator pressure set point and consequently a high coolant supply temperature as used in the invention.

FIG. 7*a* is a block diagram of the evaporator pressure control system. Here the evaporator interchanges directly with the treated air. It shows the control arrangement which is used in the invention, wherein the humidity is sensed to provide a proportional plus integral output set point.

FIG. 7*b* and FIG. 7*c* are block diagrams of the coolant supply temperature control system Here the evaporator temperature indirectly exchanges with the treated air. It shows the control arrangement which is used in the invention, wherein the treated space humidity is sensed to provide a proportional plus integral output set point and the velocity of the coolant through the cooing coil tubes is sensed to provide a proportional plus integral set point, the two outputs passing through a comparator and the maximum of those two outputs establishing an evaporator pressure set point indirectly through the coolant supply temperature that adjusts the variable speed of the compressor so that the evaporator pressure set point is compatible with the higher of the two output limits.

In addition to the proportional plus integral control system described above in relation to generating a variable evaporation temperature set point there is another control system operating independently. It's purpose is to establish the active size of the cooling coil to be compatible with the size of the heat loads in order to meet the performance standards at all operating conditions in the range at minimum energy levels.

This embodiment of the invention employs a four row deep cooling coil for a constant air volume system as presented in Table 1 and in FIG. 7*b*. It employs two solenoid valves enabling the coil to perform as a four row, a two row and a one row active coil. On a fall of load when the chilled water velocity sensor, FIG. 7*b*, item 21 measures a chilled water velocity of about 0.1 5m/s, solenoid valve 21*a* closes and the cooling coil will perform as a two row deep active coil. When both solenoid valves 21*a* and 21*b* are closed it will perform as a one row coil. In this manner the return air cooling coil fits the size of the refrigeration capacity range as it varies from peak to minimum design so as to maintain turbulent flow at all times.

When both solenoid valves are closed and there is a rise of load, the chilled water velocity sensor, 21, at approximately 2.7 n/s opens solenoid valve 21*b* first and when the chilled water velocity rises again to 2.7 nrs, solenoid valve 21*a* opens to a fully active four row deep coil.

In this embodiment each active size has been designed to fill the full face area of the coil, each circuit is of the same length and has the same number of bends and the same number of passes to ensure that at each balance point in the range the coolant flow is relatively uniform as well as in turbulent flow.

A variable air volume system is presented in Table 5 and in FIG. 7*c*. The control of the coil active size is similar to the constant air volume system of Table 1 and FIG. 7*b* with the following exceptions.

The modulating valve located downstream of the cooling coil after all coolant flow has combined, FIG. 7*c* no. 19*a* controls the supply air dry bulb temperature, no. 19, to the treated space and not the treated space dry bulb temperature. This is a common practice for variable air volume systems though exceptions occur.

As indicated under the heading above, "Brief Description of the Preferred Embodiments", FIG. 8*a* represents two psychrometric charts describing a system employing a separate outside air cooling coil and return air cooling coil. FIG. 8*a* top represents a peak, high humidity level climate. FIG. 8*a* bottom represents a low humidity level climate. FIG. 8*b* employs a single coil handling both outside air and return air. FIG. 8*b* top represents a peak high humidity level and FIG. 8*b* bottom represents a low humidity level climate.

When a single coil is employed to treat both the ventilation air and the return air as is the case with FIG. 8*b* top, two very differing combinations of sensible and latent heat loads are to be offset simultaneously with the same cooling surface. The consequence is an energy wasteful system. Unfortunately this is a very popular system in medium and low humidity climates. It is a system which, as far as energy savings is concerned, is based on fallacious reasoning. The outside air combination of sensible and latent heat loads may require a coolant supply temperature that is very low, whereas the return air combination of sensible and latent heat loads may be offset with a considerably higher coolant supply temperature. Again, this relates to the early days when energy was not considered important. At the time when the outside air is at a high humidity, a low coolant supply temperature may be necessary to offset the loads. This means that the smaller internal room loads are over cooled. Then the supply air to the rooms must be reheated. In some cases the designer manages to avoid part or all of the reheating by allowing the room dry bulb temperature to be lower. Nevertheless, it still is wasteful since the larger return air portion of the outside air-return air combination had been over cooled. In the absence of reheating, the treated space is often too cold for comfort for the occupants dressed in their summer attire.

FIG. 9 indicates present Weather Bureau Data for Singapore and Adelaide marked by curves establishing design loci for the dry bulb day time temperatures. Two very different climates such as these can be treated by the same design by this invention.

FIG. 10 shows diagrammatically a variable speed control module.

TABLE 1

Configuration: Draw-through
Type: Typical Floor
Separate O/A and R/A coils: Parallel airflow, series waterflow
CAV System
Chilled water fed to O/A coil first
Chilled water flow rate through O/A coil fixed at 1.55 lps
Air Flow (ASHRAE Std. Conditions) - Supply Air: 1020.0 lps
Outside Air 200.0 lps
Room Dry Bulb Temperature 24.0° C.

| Active Coil Depth | Ch. Water Supply Temp. ° C. | Ret Air Coil Water Vel m/s | Ch. Water Flow Rate lps | Relative Humidity % | Output Room Sens. Refrig. capacity kW | Room Sensible Heat Ratio | Tot. Output Sensible Refr. capacity kW | Tot. Output Latent Heat Capacity kW | Outside Air Condition dbt/wbt ° C. |
|---|---|---|---|---|---|---|---|---|---|
| 4 Rows (4a) | 7.00 | 2.23 | 1.56 | 51.2 | 12.9 | 0.88 | 16.51 | 9.13 | 35.0/28.0 |
| 4 Rows (4b) | 9.20 | 1.96 | 1.37 | 56.7 | 11.0 | 0.87 | 14.25 | 8.28 | 33.5/27.5 |
| 4 Rows (4c) | 11.20* | 2.26 | 1.58 | 57.4 | 10.5 | 0.88 | 12.89 | 2.37 | 30.0/21.0 |
| 4 Rows (4d) | 9.00 | 0.70 | 0.49 | 59.8 | 10.0 | 0.86 | 13.00 | 7.55 | 32.5/27.0 |
| 4 Rows (4e) | 8.00 | 0.25 | 0.17 | 60.6 | 8.5 | 0.82 | 11.37 | 4.67 | 32.0/24.0 |
| 2 Rows (2a) | 8.00 | 1.96 | 0.69 | 58.1 | 8.5 | 0.82 | 11.37 | 4.96 | 32.0/24.0 |
| 2 Rows (2b) | 14.20 | 2.17 | 0.76 | 47.1 | 6.0 | 0.85 | 8.38 | 0.00 | 30.0/17.0 |
| 2 Rows (2c) | 13.00 | 1.46 | 0.51 | 60.3 | 6.0 | 0.70 | 8.38 | 0.00 | 30.0/17.0 |
| 2 Rows (2d) | 7.00 | 0.21 | 0.07 | 59.7 | 5.8 | 0.75 | 7.64 | 6.75 | 28.0/24.9 |
| 1 Row (1a) | 7.00 | 2.11 | 0.37 | 58.7 | 5.8 | 0.75 | 7.64 | 6.86 | 28.0/24.9 |
| 1 Row (1b) | 10.00 | 0.43 | 0.08 | 59.4 | 4.4 | 0.80 | 4.85 | 6.24 | 24.0/24.0 |
| 1 Row (1c) | 7.00 | 0.30 | 0.05 | 59.6 | 4.4 | 0.69 | 5.31 | 6.94 | 24.0/24.0 |

*See Table 2a for comparison of this identical condition with performance when 7° C. chilled water in lieu of the 11.2° C. chilled water temperature is supplied by the chiller indicated here.

It should be noted that the maximum control system set point limit determining the evaporator temperature/pressure is underlined. (See columns entitled Return Air Coil Velocity and Relative Humidity to determine which value is at maximum limit.)

TABLE 2A

Performance compared at same Sensible Heat Load conditions at different chilled Water Supply Temperature
Outside Air at 30° C. dbt, 21.0 wbt

| Chilled Water supply Temp ° C. To OA Coil | Room dry bulb Temp ° C. | Room wet bulb Temp ° C. | Return Air Coil Water Vel. m/s | Output Room Sensible Ref Capacity kW | Room Sensible Heat Ratio | Room Relative Humidity % | Total Output Latent Heat Ref Capacity kW | Total Output Ref Capacity kW | Room Dew Point Temp ° C. | Water Temp. Rise OA ° C. | Water Temp. Rise RA ° C. |
|---|---|---|---|---|---|---|---|---|---|---|---|
| 7 | 24.0 | 17.4 | 0.35 | 10.5 | 0.88 | 52.4 | 2.95 | 15.82 | 13.65 | 1.2 | 7.7 |
| 11.2 | 24.0 | 18.2 | 2.26 | 10.5 | 0.88 | 57.4 | 2.37 | 15.25 | 15.07 | 0.9 | 1.4 |

TABLE 2B

Similar Comparison as above
Outside Air at 35° C. dbt, 21.5 wbt

| Chilled Water supply Temp ° C. To OA Coil | Room dry bulb Temp ° C. | Room wet bulb Temp ° C. | Return Air Coil Water Vel. m/s | Output Room Sensible Ref Capacity kW | Room Sensible Heat Ratio | Room Relative Humidity % | Total Output Latent Heat Ref Capacity kW | Total Output Ref Capacity kW | Room Dew Point Temp ° C. | Water Temp. Rise OA ° C. | Water Temp. Rise RA ° C. |
|---|---|---|---|---|---|---|---|---|---|---|---|
| 7 | 24.0 | 16.9 | 0.19 | 6.0 | 0.85 | 49.0 | 2.1 | 11.72 | 12.64 | 1.3 | 12.5 |
| 11 | 24.0 | 18.4 | 0.66 | 6.0 | 0.85 | 58.8 | 1.0 | 10.61 | 15.44 | 1.0 | 4.4 |

TABLE 3

A HUMIDITY ECONOMY CYCLE
Outside Air at 30° C. dbt, 17° C. wbt
and
Room Sensible Heat Ratio = 0.85

| Chilled Water Supply Temp ° C. | Room dbt ° C. | Room wbt ° C. | Return Air Coil Water Velocity m/s | Room Sensible Heat load kW | Room Sensible Heat Ratio | Room Relative Humidity % | Latent Heat kWR | Total Heat kWR |
|---|---|---|---|---|---|---|---|---|
| 7 | 24.0 | 16.6 | 0.15 | 6.0 | 0.85 | 46.2 | 0.10 | 8.5 |
| 8 | 24.0 | 16.6 | 0.19 | 6.0 | 0.85 | 47.1 | 0.0 | 8.4 |
| 9 | 24.0 | 16.6 | 0.23 | 6.0 | 0.85 | 47.1 | 0.0 | 8.4 |
| 10 | 24.0 | 16.6 | 0.28 | 6.0 | 0.85 | 47.1 | 0.0 | 8.4 |
| 11 | 24.0 | 16.6 | 0.35 | 6.0 | 0.85 | 47.1 | 0.0 | 8.4 |
| 12 | 24.0 | 16.6 | 0.47 | 6.0 | 0.85 | 47.1 | 0.0 | 8.4 |
| 13 | 24.0 | 16.6 | 0.70 | 6.0 | 0.85 | 47.1 | 0.0 | 8.4 |
| 14.2 | 24.0 | 16.6 | 2.17 | 6.0 | 0.85 | 47.1 | 0.0 | 8.4 |

TABLE 4

A HUMIDITY ECONOMY CYCLE
Outside Air at 30° C. dbt, 17° C. wbt
and
Room Sensible Heat Ratio = 0.70

| Chilled Water Supply Temp ° C. | Room dbt ° C. | Room wbt ° C. | R/A Coil Ch Water Velocity m/s | Room Sensible Heat load kW | Room Sensible Heat Ratio | Room Relative Humidity % | Latent Heat kWR | Total Heat kWR |
|---|---|---|---|---|---|---|---|---|
| 7 | 24 | 18.51 | 0.182 | 6.0 | 0.70 | 59.4 | 0.11 | 8.49 |
| 12 | 24 | 18.65 | 0.783 | 6.0 | 0.70 | 60.3 | 0.00 | 8.39 |
| 13 | 24 | 18.65 | 1.464 | 6.0 | 0.70 | 60.3 | 0.00 | 8.39 |

TABLE 5

Configuration: Drawthrough
Separate O/A and R/A coils: Parallel airflow, series waterflow,
4 row active depth of OA
VAV SYSTEM
Chilled water fed to O/A coil first
Chilled water flow rate through O/A coil fixed at 1.8 Lps
Air Flow (ASHRAE Std Conditions)
Outside Air 200.0 Lps at all runs
Supply Variable Air 505 Lps to 1060 Lps
Room Dry Bulb Temperature 24.0° C.
Room Supply Air Dry Bulb Temperature 14.4° C.

| | Comments | Chilled Water Supply Temp ° C. | Rows Deep | Return Air Coil Water Vel. m/s | Return Air Coil Flow Rate Lps | Room Relative Humidity % | Room Sens Heat Load kW | Room Sensible Heat Ratio | Total Output Sensible Refr. Capacity kW | Total Output Latent Heat Capacity kW | Total Output Refridgeration Capacity kW | Outside Air Cond. Dbt/wbt ° C. | Supply Air to Zone |
|---|---|---|---|---|---|---|---|---|---|---|---|---|---|
| a | | 7.0 | 4.0 | 2.0 | 1.000 | 57.8 | 12.5 | 0.7 | 16.1 | 12.0 | 28.1 | 35/28 | 1060 |
| b | Singapore Peak | 7.7 | ↑ | 2.1 | 1.100 | 53.2 | 12.5 | 0.8 | 15.7 | 10.8 | 26.5 | 33/28 | 1055 |
| c | | 8.5 | \| | 1.9 | 1.000 | 50.2 | 11.9 | 0.9 | 15.5 | 8.8 | 24.3 | 35/28 | 1005 |
| d | | 8.5 | \| | 2.5 | 1.300 | 58.9 | 9.5 | 0.7 | 11.7 | 8.5 | 20.2 | 30/25 | 800 |
| e | Adelaide Peak | 8.5 | \| | 2.0 | 1.100 | 52.9 | 12.5 | 0.8 | 16.9 | 3.0 | 19.9 | 38/21.5 | 1055 |
| f | | 7.0 | \| | 0.6 | 0.300 | 59.4 | 9.5 | 0.7 | 11.2 | 8.0 | 19.2 | 28/24 | 800 |
| g | | 7.0 | \| | 0.5 | 0.300 | 59.8 | 9.0 | 0.7 | 9.7 | 8.8 | 18.4 | 24/24 | 760 |
| h | | 10.0 | \| | 2.7 | 1.400 | 54.7 | 9.5 | 0.8 | 11.2 | 6.8 | 18.0 | 28/24 | 800 |
| i | Humidity Economy Cycle | 9.0 | \| | 2.2 | 1.200 | 50.4 | 12.5 | 0.9 | 16.1 | 1.0 | 17.2 | 35/19 | 1055 |
| j | | 9.5 | \| | 1.0 | 0.500 | 60.0 | 8.0 | 0.7 | 8.6 | 8.3 | 16.9 | 24/24 | 680 |
| k | | 10.5 | \| | 2.3 | 1.200 | 51.9 | 9.0 | 0.9 | 9.7 | 6.8 | 16.5 | 24/24 | 760 |
| l | Humidity Economy Cycle | 9.0 | \| | 2.2 | 1.200 | 52.0 | 12.5 | 0.8 | 14.9 | 1.5 | 16.4 | 30/17 | 1055 |
| m | | 7.0 | \| | 0.2 | 0.100 | 60.8 | 7.0 | 0.7 | 7.5 | 7.6 | 15.1 | 24/24 | 590 |
| n | | 10.0 | \| | 2.1 | 1.100 | 52.3 | 10.6 | 0.8 | 12.9 | 1.0 | 13.9 | 30/17 | 895 |
| o | | 9.0 | \| | 0.2 | 0.100 | 60.9 | 6.0 | 0.7 | 6.4 | 7.2 | 13.6 | 24/24 | 505 |
| p | Humidity Economy Cycle | 11.0 | \| | 2.1 | 1.111 | 52.2 | 9.0 | 0.8 | 11.1 | 0.6 | 11.7 | 30/17 | 759 |
| o' | Unstable Conventional | 7.0 | ↓ | 0.1 | 0.055 | 59.3 | 6.0 | 0.7 | 6.4 | 7.4 | 13.8 | 24/24 | 505 |
| q | | 7.0 | 2.0 | 0.28 | 0.096 | 58.5 | 6.0 | 0.7 | 6.4 | 7.45 | 13.85 | 24/24 | 505 |
| ri | | 9.0 | ↑ | 1.25 | 0.438 | 57.8 | 6.0 | 0.7 | 6.4 | 7.54 | 13.93 | 24/24 | 505 |
| s | | 9.5 | ↓ | 2.43 | 0.851 | 57.7 | 6.0 | 0.7 | 6.4 | 7.55 | 13.95 | 24/24 | 505 |

*It should be noted that the maximum control system set point limit determining the evaporator temperature is underlined. (See column entitled Return Air Coil Water Velocity and Relative Humidity to determine which value is at maximum limit.)

What is claimed is:

1. A method of controlling an air conditioning system, the air conditioning system being capable of treating a conditioned space by at least treating return air from the conditioned space in return air coils, the air conditioning system having at least one compressor and an evaporator and circulating a coolant through the return air coils, the return air coils having control valves capable of regulating coolant flow, and having a size that is able to be varied between a minimum and a maximum, wherein the method comprises the steps of:

(a) setting desired temperature and humidity set points for the conditioned space;

(b) setting desired maximum and minimum coolant velocity set points for the velocity of coolant through the return air coils;

(c) measuring the conditioned space temperature and providing a temperature control signal computed from a deviation value of the conditioned space temperature from the temperature set point, the temperature deviation value being representative of changed sensible heat load requirements;

(d) measuring the coolant velocity through the return air coils and providing a coolant velocity control signal computed from a deviation value of the coolant velocity from the maximum coolant velocity set point;

(e) measuring the conditioned space humidity and providing a humidity control signal computed from a deviation value of the conditioned space humidity from the conditioned space humidity set point, the humidity deviation value being representative of changed evaporator temperature and latent heat load requirements;

(f) in response to the temperature control signal, varying the coolant flow to the return air coils by regulating the control valves to meet the changed sensible heat load requirements;

(g) in response to the coolant velocity control signal, varying the size of the return air coils such that the changed size prevents the coolant velocity from exceeding the maximum coolant velocity or from reducing below the minimum coolant velocity;

(h) subsequent to a variation in size of the return air coils, providing an adjusted coolant velocity control signal; and (i) in response to the higher of the coolant velocity control signals and the humidity control signal, providing an evaporator temperature control signal to adjust the evaporator temperature to a maximum to thereby optimize input energy reduction.

2. The method according to claim 1, wherein the air conditioning system additionally treats ventilation air from outside the conditioned space in outside air coils and mixes the treated outside air with the return air before supplying the treated mixture to the conditioned space, the coolant circulating through the outside air coils before passing to the return air coils.

3. The method according to claim 1, further comprising the step of increasing the coolant velocity to at or above the minimum coolant velocity set point by decreasing the size of the return air coils, if the coolant velocity is below the minimum coolant velocity set point.

4. The method according to claim 1, wherein the air conditioning system is a variable or constant air volume system that directly or indirectly treats the air in the conditioned space.

5. The method according to claim 1, wherein the air conditioning system is a variable or constant air volume system where indirectly a coolant treats the air in the conditioned space and utilizes a chiller as at least part of that treatment.

6. The method according to claim 1, wherein the adjustment of the evaporator temperature is effected by controlling compressor capacity.

7. The method according to claim 1, wherein the control signals relating to humidity, temperature and coolant velocity are provided by proportional plus integral controllers.

8. A method of controlling an air conditioning system, the air conditioning system being capable of treating a conditioned space by at least treating return air from the conditioned space, the air conditioning system having at least one compressor with a predetermined minimum compressor speed and an evaporator providing heat exchange with return air and outside air, the evaporator having a size that is able to be varied between a minimum and a maximum, wherein the method comprises the steps of:

(a) setting desired temperature and humidity set points for the conditioned space;

(b) measuring the conditioned space temperature and providing a temperature control signal computed from a deviation value of the conditioned space temperature from the temperature set point, the temperature deviation value being representative of changed sensible heat load requirements;

(c) measuring the conditioned space humidity and providing a humidity control signal computed from a deviation value of the conditioned space humidity from the humidity set point, the humidity deviation value being representative of changed evaporator temperature and latent heat load requirements;

(d) in response to the temperature control signal, varying flow of refrigerant in the evaporator such that the changed sensible heat load requirements are met; and (e) in response to the humidity control signal, providing an evaporator temperature control signal to adjust the evaporator temperature to a maximum to thereby optimize input energy requirements, said maximum evaporator temperature being limited such that the compressor speed does not reduce below the predetermined minimum compressor speed.

9. The method according to claim 8, wherein the air conditioning system additionally treats outside air and return air in separate evaporators, or in separate portions of evaporators, and mixes the treated outside air with the treated return air before supplying the mixture to the conditioned space.

10. The method according to claim 8, wherein the air conditioning system is a variable or constant air volume system that directly treats the air in the conditioned space.

11. The method according to claim 8, wherein the control signals relating to humidity and temperature are provided by proportional plus integral controllers.

12. The method according to claim 8, wherein the adjustment of the evaporator temperature is effected by controlling compressor capacity.

13. An apparatus for controlling an air conditioning system, the air conditioning system being capable of treating a conditioned space by at least treating return air from the conditioned space in return air coils, the air conditioning system having at least one compressor and an evaporator and circulating a coolant through the return air coils, the return air coils having a size that is able to be varied between a minimum and a maximum, the apparatus comprising:

(a) a conditioned space humidity sensor, a conditioned space temperature sensor, and a coolant velocity sensor for determining the velocity of the coolant entering the return air coils;

(b) an evaporator temperature controller;

(c) means for providing a temperature control signal computed from a deviation value of conditioned space temperature from a temperature set point;

(d) means for providing a humidity control signal computed from a deviation value of conditioned space humidity from a humidity set point;

(e) means for providing a coolant velocity control signal computed from a deviation value of coolant velocity from a coolant velocity set point;

(f) means for varying the return air coil size in response to the coolant velocity control signal;

(g) means for varying the coolant velocity to the return air coils in response to the temperature control signal; and (h) control means capable of receiving the humidity control signal and the coolant velocity control signal, selecting the higher control signal and providing a control signal to the evaporator temperature controller to adjust the evaporator temperature to a maximum to thereby optimize input energy requirements.

14. The apparatus according to claim 13, wherein the air conditioning system further comprises outside air coils for treating ventilation air from outside the conditioned space, the outside air coils having coolant circulating therethrough, and a means for mixing the treated outside air with the treated return air before supplying the mixture to the conditioned space.

15. The apparatus according to claim 13, wherein the air conditioning system is a variable or constant air volume system that indirectly treats the air in the conditioned space.

16. The apparatus according to claim 13, wherein the air conditioning system is a variable or constant air volume system where indirectly coolant treats the air in the conditioned space and utilizes a chiller as at least part of that treatment.

17. The apparatus according to claim 13, wherein the control signals relating to humidity, temperature and coolant velocity are provided by proportional plus integral controllers.

18. The apparatus according to claim 13, wherein the adjustment of the evaporator temperature is effected by controlling compressor capacity.

19. An apparatus for controlling an air conditioning system, the air conditioning system being capable of treating a conditioned space by at least treating return air from the conditioned space, the air conditioning system having at least one compressor with a predetermined minimum compressor speed and an evaporator providing heat exchange with return air and outside air, the evaporator having a size that is able to be varied between a minimum and a maximum, the apparatus comprising:

(a) a conditioned space humidity sensor and a conditioned space temperature sensor;

(b) an evaporator temperature controller;

(c) means for providing a temperature control signal computed from a deviation value of conditioned space temperature from a temperature set point;

(d) means for providing a humidity control signal computed from a deviation value of conditioned space humidity from a humidity set point;

(e) means for varying the evaporator size in response to the temperature control signal; and (f) control means capable of receiving the humidity control signal and providing a control signal to the evaporator temperature controller to adjust the evaporator temperature to a maximum to thereby optimize input energy requirements, said maximum evaporator temperature being limited such that the compressor speed does not reduce below the predetermined minimum compressor speed.

20. The apparatus according to claim 19, wherein the air conditioning system utilizes an evaporator for treating both ventilation air from outside the conditioned space and return air, the evaporator having refrigerant circulating therethrough, and a means for mixing the treated outside air with the treated return air before supplying the mixture to the conditioned space.

21. The apparatus according to claim 19, wherein the air conditioning system is a variable or constant air volume system that directly treats the air in the conditioned space.

22. The apparatus according to claim 19, wherein the air conditioning system is a variable or constant air volume system where an evaporator directly treats the air in the conditioned space and utilizes a refrigerant cycle as at least part of that treatment.

23. The apparatus according to claim 19, wherein the control signals relating to humidity and temperature are provided by proportional plus integral controllers.

24. The apparatus according to claim 19, wherein the adjustment of the evaporator temperature is effected by controlling compressor capacity.

* * * * *